US010463091B2

(12) United States Patent
Bourque

(10) Patent No.: US 10,463,091 B2
(45) Date of Patent: Nov. 5, 2019

(54) FACE COVER

(71) Applicant: Outeru Gear, Inc., Milton, VT (US)

(72) Inventor: Kevin C. Bourque, Wolfeboro, NH (US)

(73) Assignee: OuterU Gear, Inc., Milton, VT (US)

( * ) Notice: Subject to any disclaimer, the term of this patent is extended or adjusted under 35 U.S.C. 154(b) by 47 days.

(21) Appl. No.: 13/874,875

(22) Filed: May 1, 2013

(65) Prior Publication Data

US 2013/0291272 A1 Nov. 7, 2013

Related U.S. Application Data

(60) Provisional application No. 61/641,047, filed on May 1, 2012.

(51) Int. Cl.
*A41D 13/11* (2006.01)

(52) U.S. Cl.
CPC ..... *A41D 13/11* (2013.01); *A41D 13/1107* (2013.01); *A41D 13/1161* (2013.01)

(58) Field of Classification Search
CPC . A41D 13/11; A41D 13/1107; A41D 13/1115; A41D 13/1123; A41D 13/1138; A41D 23/00; A61F 9/04; A61F 9/045; A61F 13/126; A61F 2013/00578; A41G 7/00; A41G 7/02; A42B 1/06
USPC ..... 2/206, 202, 203, 9; 602/74, 17; 128/857, 858; D29/108, 106
See application file for complete search history.

(56) References Cited

U.S. PATENT DOCUMENTS

| | | | | | |
|---|---|---|---|---|---|
| 167,543 | A | * | 9/1875 | Kleinert | 2/206 |
| 309,491 | A | | 12/1884 | Price | |
| 351,248 | A | | 10/1886 | Britton | |
| 364,733 | A | | 6/1887 | Sentman | |
| 366,788 | A | * | 7/1887 | Nehemias | 2/206 |
| 587,687 | A | * | 8/1897 | Harder | 2/206 |
| 766,963 | A | | 8/1904 | Murray | |
| 825,170 | A | * | 7/1906 | Allen | 2/206 |
| 1,070,584 | A | * | 8/1913 | Byron | A41D 13/11 2/206 |
| 1,110,772 | A | * | 9/1914 | Gunderman | 128/848 |

(Continued)

FOREIGN PATENT DOCUMENTS

| | | | |
|---|---|---|---|
| EP | 0972460 | | 1/2000 |
| JP | 08089616 | A * | 4/1996 |

*Primary Examiner* — Amy Vanatta
(74) *Attorney, Agent, or Firm* — Verrill Dana, LLP; John W. Powell

(57) ABSTRACT

Face covers, protective outwear systems, and methods for manufacturing the same are disclosed. A cover is disclosed for protecting the human face, head, neck, and/or shoulders against environmental conditions. The cover, which does not cover the eyes, nostrils or mouth, includes 2-4 separate pieces which can be worn together or individually. A first piece covers the face from above the mouth to below the eyes, including the nose and cheeks. A second piece covers the face from below the mouth to the bottom of the neck. These pieces can overlap on the cheeks to minimize/prevent air and moisture from reaching the face. A third piece covers the head and/or neck and/or shoulders. These pieces can be joined together by any known means. Any piece can be made with a moldable material and/or elastic components which allow the mask to fit different faces and/or help ventilate exhalations away from the face.

16 Claims, 23 Drawing Sheets

(56) References Cited

U.S. PATENT DOCUMENTS 1,247,222 A * 11/1917 Cauffman ..... 128/848
1,291,846 A * 1/1919 Greenfield ..... 2/206
1,761,664 A 6/1930 Harris
2,024,491 A * 12/1935 Veysey ..... 602/79
2,259,537 A * 10/1941 Wengen ..... 2/202
2,276,612 A 3/1942 Ellis
2,718,584 A 9/1955 Hariu
2,790,175 A * 4/1957 Sowle ..... 2/9
3,346,875 A * 10/1967 Weisberger ..... G02C 5/12 2/9
3,594,813 A * 7/1971 Sanderson ..... A61F 13/126 128/857
3,768,100 A 10/1973 Colman et al.
3,878,563 A 4/1975 Pulju
4,250,577 A 2/1981 Smith
4,259,748 A 4/1981 Miller
4,300,240 A 11/1981 Edwards
D274,385 S * 6/1984 Newcomb ..... G02C 5/12 D29/108
4,593,417 A * 6/1986 Brown, Jr. et al. ..... 2/172
4,641,379 A * 2/1987 Martin ..... A41D 13/1161 128/206.28
4,674,133 A * 6/1987 Oschner ..... A61F 13/126 2/15
4,825,474 A * 5/1989 Edwards ..... A41D 13/1161 2/206
4,827,923 A * 5/1989 Bishop ..... A41D 13/11 128/206.11
5,214,804 A * 6/1993 Carey ..... A41D 13/1161 2/171
5,220,689 A 6/1993 Miller
5,379,463 A 1/1995 Schleger et al.
5,438,710 A 8/1995 McDonald et al.
5,592,687 A 1/1997 Lajeunesse
5,666,664 A 9/1997 Hamilton
D388,533 S * 12/1997 Uemura ..... A41D 13/11 D28/4
5,697,100 A 12/1997 Horowitz et al.
5,704,063 A 1/1998 Tilden
5,809,572 A 9/1998 Sisolak
6,012,164 A 1/2000 Deal, III
6,039,710 A * 3/2000 Kelley et al. ..... 602/74
6,070,265 A * 6/2000 Tasbas ..... A41D 13/11 128/858
6,079,980 A * 6/2000 Durand ..... A61C 19/00 128/206.13
6,098,201 A 8/2000 Boros, Sr.
D441,081 S 4/2001 Mueller
6,272,690 B1 * 8/2001 Carey ..... A41D 13/11 2/171
6,649,181 B1 * 11/2003 Miner ..... A61K 8/0208 424/401
7,096,511 B2 * 8/2006 Cohen ..... 2/206
7,603,724 B2 10/2009 Mickle
D670,037 S 10/2012 Chen
8,359,669 B2 1/2013 Tonegawa
8,387,163 B2 3/2013 Beliveau
8,484,762 B2 * 7/2013 Goldstein ..... A42B 1/08 2/9
2009/0241242 A1 * 10/2009 Beatty ..... A45D 44/002 2/206
2010/0218304 A1 9/2010 Tonegawa
2010/0258130 A1 * 10/2010 Wu ..... A41D 13/1107 128/206.13
2011/0239347 A1 10/2011 Beliveau
2012/0167891 A1 * 7/2012 Smaller ..... A41D 13/11 128/206.19

* cited by examiner

FIG. 2A
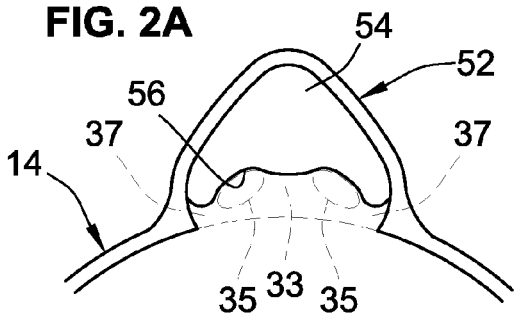
FIG. 2B
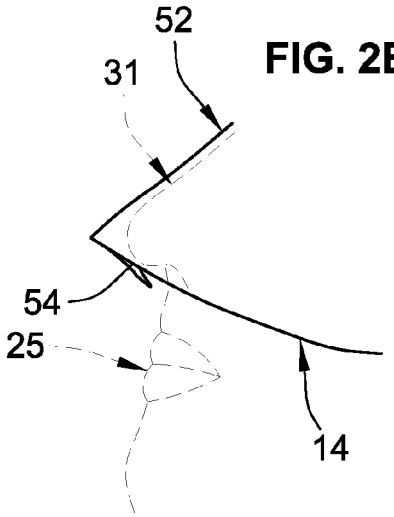
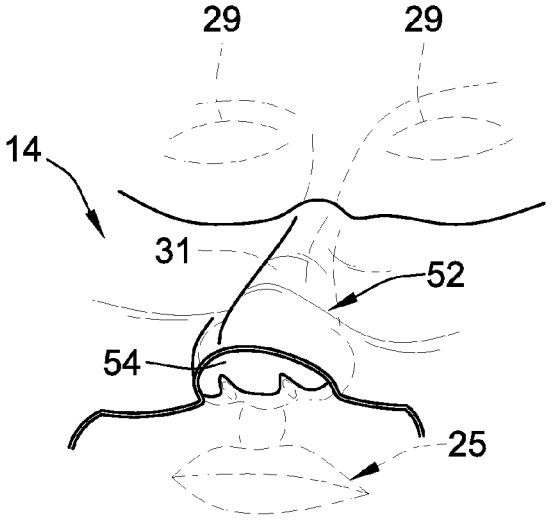
FIG. 2C

FACE COVER

CLAIM OF PRIORITY AND CROSS-REFERENCE TO RELATED APPLICATION

This application claims the benefit of and priority to U.S. Provisional Patent Application No. 61/641,047, which was filed on May 1, 2012, and is incorporated herein by reference in its entirety.

TECHNICAL FIELD

The present disclosure relates generally to clothing and protective outerwear. More particularly, the present disclosure relates to face covers and masks worn for protecting the face and neck of a user, for example, from harsh environments and injury.

BACKGROUND

Face covers and face masks are worn for a variety of purposes, including for protection from inclement weather by outdoor enthusiasts, climbers, hunters, skiers, snowmobilers, motorcyclists, constructions workers, utility workers, and others who are frequently exposed to cold weather, sleet and snow. Masks are also used to protect users against the sun and sunburn, to prevent wind burns, and to guard against rain. Some covers and masks are designed for protection against facial injuries from impact, for example, from hockey pucks, baseballs, and the like during athletic games. Industry specific masks and face guards are also very common, such as surgical masks for protecting medical staff against infection and welding headgear for protecting the face against flash burn and sparks.

Human skin and tissue can be damaged by exposure to various elements and environmental forces, including sun, cold, wind, moisture, and flying debris. Chemical and natural lotions and creams provide some protection against sun and wind, but only direct covering by solid materials, such as textiles, composites, and animal hide, protect against all the aforementioned environmental forces. For protection against and comfort among these environmental forces, an array of body coverings exist, including the aforementioned face covers and face masks. Existing face covers are made from an array of materials including neoprene, fleece, nylon, and leather. Most face-covering masks cover just the nose and mouth using a single piece of material that is attached to the user's head.

For ventilation, some face masks include a series of small holes in the face-covering material, while some include complex plastic and wool air filtering systems attached to the material of the face-cover. Many mouth coverings are impractical if the user needs access to his or her mouth for eating, drinking, communication, and the like. In addition, no matter the type of mouth-covering, water vapor in the form of breathing exhaust tends to condense on the mask material around the user's nose and mouth from which it is expelled. This water-vapor, which either freezes or remains wet, is uncomfortable against and can irritate the user's face. Warm air, when expelled from under the face mask, typically does not escape into the atmosphere immediately, but instead travels between the mask and the user's face until it reaches the upper edge of the mask below the user's eyes, where it is exhausted, oftentimes condensing on a user's glasses or goggles as fog. For users who need to see while protecting their eyes with eyewear, preventing goggle-fog created by breathing exhaust mismanagement is of great concern.

Many face covers and masks envelop the entire nose or cover nearly all of the nose. As warm air exiting the nose rises, any material covering the nostrils prevents nose exhaust from immediately escaping into the atmosphere. This nasal breathing exhaust becomes trapped under the mask where it naturally travels up between the mask and the face to the eye opening, where it is expelled, oftentimes fogging up a wearer's glasses or goggles. As many people wear face-covers in combination with glasses or goggles, and require that the eyewear functions properly, getting as much of the nasal exhaust away from the mask can be highly desirable.

U.S. Pat. No. 5,704,063, which issued to Mark Tilden on Jan. 6, 1998, presents a face protector with a covering body for covering a user's face below the eyes, and attachments for attaching the covering body to the user's head. The face protector includes a "breathing vent skirt" for covering the user's nose. One drawback to this design is that Tilden's breathing vent skirt leaves the nostrils exposed and does not properly protect the tip of the nose. In addition, Tilden's nose vent skirt extends from the tip of the nose to a point "so as to be at a level at least as low as the upper edge of the upper lip of the user." Consequently, as seen in the various views provided by Tilden, the skirt extends down too far and traps a great deal of nose and mouth exhaust. In so doing, warm air is forced to travel up between the mask and the user's face until it is exhausted along the upper edge of the mask beneath the eyes where it can condense on goggle lenses. Moreover, warm mouth-exhaust, together with breathing exhaust trapped by the nose vent skirt, is collected between the user's face and the mask where it condenses.

Many face-coverings cover the entire face above and below the mouth with one unit of soft material. These masks are pulled over the head and down over the face, or they are set on the face and strapped behind the head, for example, using a hook-and-loop system like Velcro™ Masks like these include holes for the eyes, nostrils, and mouth. As the human head is two pieces that open and close at the mouth, hinged at the jaw, a mask that is tight to the bridge the nose and the bottom of the jaw would obstruct and inhibit the opening of the mouth and, in general, normal facial movement. Certain environments and users do not require protection for the entire face. Two-piece face covers, in which the first part covers the nose and cheeks of the user, the most sensitive portions of the face, and the second part covers the jaw, would allow the user to cover only half of his or her face if desired.

Some two-piece masks suggest a bottom section that is like a bandana or scarf. These designs are undesirable because they can easily get caught in a zipper and typically do not properly insulate the face because they do not contour the face well enough to retain warm air between the face and mask. The lower piece of such masks are typically attached to the user's head by a lone strap which extends around the neck. However, such strapping means are ineffective to keep the lower piece in place. In addition, the bottom piece of these two-part systems are spaced from the upper piece and, thus, do not completely cover the user's cheeks. This leaves skin exposed to the elements and also allows heat to escape. Also, the upper piece of many two-piece masks does not properly insulate the tip of the nose or, conversely, presents too much material projecting downward from the tip of the nose which catches breathing exhaust instead of properly venting the exhaust.

Most face covers fasten behind the head, opposite the nose. Unfortunately, such straps typically do not stay in place when a hat or helmet is slid over the strap. Since many people who wear a face mask also wear a hat or helmet, the ability to maintain proper attachment of the mask while sliding a hat or helmet over the strap is often of great concern. Also, the normal movement of the face and jaw tends to cause such strapping means to slip down around the back of the neck where it loses tension and, thus, no longer properly secures the mask to the user's face.

The tip of the nose on the human face is one of the most susceptible to frost bite and one of the most sensitive to sunburn and skin cancer. Most face covers either leave the nose completely exposed, envelop the entire nose, or cover the nose with material that projects beyond and below it, but not that directly covers or wraps around the tip of the nose. Sun exposure can cause unwanted redness, painful sunburns, and can lead to skin cancer. For these reasons people wear large-brimmed hats, sunglasses, and hoods to cover their faces. People also use an array of sun-blocking creams, and lotions, some of which irritate the skin. Many face covers are not made of fabric suited specifically for blocking the sun.

SUMMARY

Disclosed herein are face covers, protective face mask systems, methods for manufacturing a face cover, and methods of using a face cover (wherein "face cover," "face mask," "face protector," and general modification thereof can be used interchangeably herein). Many of the disclosed embodiments address and ameliorate one or more of the above-mentioned deficiencies in the prior art. Some aspects of the disclosed concepts are directed to a face cover that is designed to stay in a desired location—covering the areas around the mouth, including some or all of the bottom lip in some cases, without covering or obstructing the entire mouth—which can help prevent goggle-fog and uncomfortable wetness or ice build-up on the mask. In a similar regard, some designs cover and protect most of the nose, including the bridge and tip, while limiting the material around the nostrils to prevent condensation from breathing exhaust collecting on the mask around the nose where it can cause uncomfortable wetness or ice build-up. Since the tip of the nose is particularly sensitive to the sun and the cold, this design covers and protects the tip of the nose without obstructing the ventilation of breathing exhaust.

Some aspects are directed to a multi-piece face cover designed to alleviate the discomfort and restrictions associated with single-piece masks. Some of these multi-piece constructions allow the user's mouth to open and close normally without affecting the fit or positioning of the mask on the face. For some designs, the mask includes at least one strap that extends over the crown of the user's head to help ensure that the mask will stay pressed against and properly situated on the bottom part of the face. In this regard, it is often desirable that the bottom piece of a multi-part system covers the cheeks to provide redundant protection when used with the upper section. Optional features can include ear loops to improve comfort and function. In accord with some of the disclosed concepts, one or more pieces of the mask can be individually pulled off the face and temporarily set under the chin or on the forehead to ventilate the face, and subsequently moved back into place. For some such designs, straps with a high stretch coefficient may be desirable.

Some of the disclosed masks include attachment means for proper suspension from behind the neck. For example, a strap or piece of stretchy fabric can extend behind the neck to secure the upper portion of the mask to the nose, to prevent the bottom edge of the upper portion from flapping in the wind and/or to hold the upper portion firmly against the cheeks for proper insulation. Optionally, another strap/band can extend around the neck and secure the bottom portion of the mask beneath the mouth and hold the bottom portion flush against the jaw and cheeks. For some embodiments, both the upper and lower mask pieces include a respective strap that extends over and around the crown of the user's head to ensure proper positioning and placement of each piece on the user's face.

According to one aspect of the present disclosure, a face protector assembly is disclosed. The face protector assembly includes two primary pieces: a lower mask piece and an upper mask piece. The lower mask piece has opposing first top and bottom edges, and includes a first attachment mechanism configured to attach the lower mask piece to the head of a user. The lower mask piece is configured to extend across and cover the user's chin and at least a portion of the user's cheeks. The lower mask piece is also configured to situate such that the portion of the first top edge proximate the user's mouth is on or below the user's bottom lip such that the lower mask piece does not obstruct the user's mouth. The upper mask piece has opposing second top and bottom edges, and includes a second attachment mechanism configured to attach the upper mask piece to the user's head. The upper mask piece is configured to extend across and cover at least a portion of the user's cheeks and substantially all of the user's nose, including the tip and bridge but not the nostrils. The upper mask piece is also configured to situate such that the portion of the second bottom edge proximate the user's mouth is on or above the user's top lip and the upper mask piece does not obstruct the user's mouth.

According to another aspect of the present disclosure, the face protector assembly also includes a protector piece configured to extend across and cover at least the user's neck and head. The protector piece can be further configured to extend across and cover at least a portion of the user's shoulders, at least a portion of the user's face, or both. The protector piece can include a region of increased elasticity adjacent the user's neck, wherein the region of increased elasticity is configured to increase mobility of the user's head. The protector piece can optionally include a facial opening configured to encircle the user's face such that at least the user's eyes and nose project through the facial opening.

According to yet another aspect of the present disclosure, a multi-piece face mask is featured for covering and protecting select portions of a human head, neck, and face. The head has a crown, and the face has eyes, cheeks, a mouth with top and bottom lips, a chin, and a nose with nostrils, a bridge, and a tip. The face mask includes upper and lower mask pieces. The lower mask piece has opposing first top and bottom edges, and one or more first straps configured to attach the lower mask piece to the head. At least one of these straps is configured to extend around the crown of the head. The lower mask piece is configured to extend across and cover the chin, at least a portion of the neck, and at least a portion of the cheeks. The lower mask piece is also configured to abut the face and situate such that the portion of the first top edge proximate the mouth is on or below the bottom lip and does not cover the top lip or obstruct the mouth. The upper mask piece has opposing second top and bottom edges, and one or more second straps configured to attach the upper mask piece to the head. At least one of these straps is configured to extend around the crown of the head. The upper mask piece is configured to extend across and cover at least a portion of the cheeks, and substantially all of the nose, including the bridge, tip, and at least some of the nasal columella, but not the nostrils. The upper mask piece is also configured to abut the face and situate such that the portion of the bottom edge proximate the mouth is on or above the top lip and does not cover the bottom lip or obstruct the mouth. The upper and lower mask pieces are separate from one another and independently repositionable on the face.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and modes for carrying out the present invention when taken in connection with the accompanying drawings and the appended claims.

BRIEF DESCRIPTION OF THE DRAWINGS

FIGS. 2A-2C are a series of alternative views of the nose area of an upper mask piece of a multi-piece face protector assembly in accordance with aspects of the present disclosure.

Figure 1:
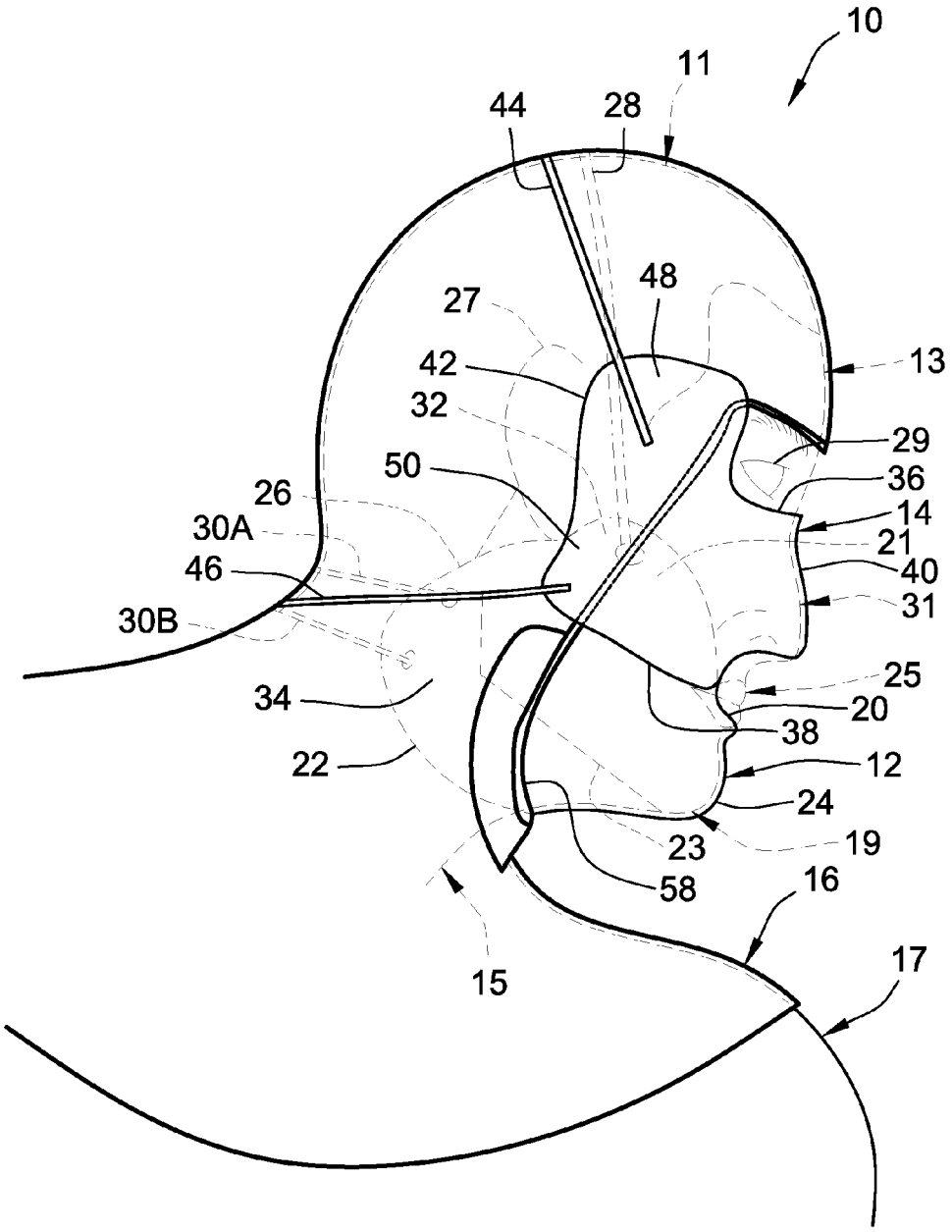
FIG. 1 is a perspective view illustration of a multi-piece face protector assembly in accordance with aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This invention is susceptible of embodiment in many different forms. There are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" mean "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring to the drawings, wherein like reference numerals refer to like features throughout the several views, there is shown in FIG. 1 a representative face protector assembly, designated generally as 10, in accordance with aspects of the present disclosure. The illustrated face protector assembly 10 (sometimes referred to herein as "face cover," "face mask," "face protector," and general modifications thereof) is intended for protecting select portions of the head, face, and neck, respectively designated as 11, 13 and 15 in FIG. 1, of a user, for example, from harsh environments and injury (e.g., to guard against sleet and snow, sunburn, wind burn, and/or rain). However, it should be recognized that the face protector assembly 10 is not so limited and therefore may be utilized for other purposes (e.g., to guard against sport injuries, industry specific injuries, etc.) without departing from the scope and spirit of the present disclosure. In addition, the drawings presented herein are not necessarily to scale and are provided purely for explanatory purposes. Thus, the specific and relative dimensions shown in the drawings are not to be considered limiting unless explicitly stated otherwise in the claims.

The face protector assembly 10 is a multi-piece assembly including at least two and, in some configurations, three or more separate, attachable and independently movable pieces. In the embodiment illustrated in FIG. 1, for example, the face protector assembly 10 includes a lower mask piece 12, an upper mask piece 14, and a protector piece 16. The lower mask piece 12 has opposing (first) top and bottom edges 20 and 22, respectively, interconnecting opposing (first) front and back ends 24 and 26, respectively. In the view provided in FIG. 1, the bottom edge 22 and back end 26 of the lower mask piece 12 are both shown with hidden lines because they are underneath and covered by the upper mask piece 14 and/or the protector piece 16. As persons of ordinary skill in the art will readily recognize, the use of spatial adjectives, such as "front," "back," "top," "bottom," "upward," "downward," etc., in the specification and claims are generally intended to specify the comparative orientation of a given component or segment relative to a human head of an upright user when operatively mounted thereto.

The lower mask piece 12 includes an (first) attachment mechanism that is configured to attach the lower mask piece 12 to the head 11 of a user. As shown in FIG. 1, the first attachment mechanism includes one or more straps, namely a (first) crown strap 28 and a pair of (first) neck straps 30A and 30B. Each opposing end of the crown strap 28 is attached to a respective cheek portion (only one of which is visible in FIG. 1 at 32, but an identical counterpart is located on the opposite side of the user's head) of the lower mask piece 12 on opposite sides of the user's head 11. The crown strap 28, when properly situated, extends from the check portions 32 over and around the crown of the user's head 11. In this regard, each opposing end of the neck straps 30A, 30B is attached to a respective neck portion (one of which is visible in FIG. 1 at 34, but an identical counterpart is located on the opposite side of the user's head) of the lower mask piece 12 on opposite sides of the user's head 11. The neck straps 30A, 30B, when properly situated, extend from the back end 26 of the lower mask piece 12 rearward and around the back of the user's neck 15. The crown and neck straps 28, 30A-B cooperatively ensure that the lower mask piece 12 will stay pressed against and properly situated on the bottom part of the user's face 13. Because the crown and neck straps 28, 30A-B are underneath the protector piece 16, these straps are shown with hidden lines in FIG. 1. Recognizably, the first attachment mechanism may comprise greater or fewer than three straps, or may comprise other attachment means, such as buttons, bands, hook and loop fasteners, snap fasteners, alone or in any combination, without departing from the scope of this disclosure.

When properly situated on and attached to the user's head 11, the lower mask piece 12 of FIG. 1 extends across and covers the user's chin 19, a portion of the user's cheeks 21, and a portion of the user's neck 15 and jaw 23. Moreover, the lower mask piece 12 is configured to situate such that the portion of the top edge 20 that is proximate the user's mouth 25 sits on or below the user's bottom lip, which helps to ensure that the lower mask piece 12 does not cover or obstruct the user's mouth 25. In the embodiment of FIG. 1, the lower mask piece 12 is also configured to situate such that the portion of the bottom edge 22 that is proximate the front of the user's neck 15 sits above the larynx so that the lower mask piece 12 does not impede movement of the head 11 on the neck 15. As will be discussed in extensive detail below, the lower mask piece 12 may take on various alternative shapes and sizes, and include a number of optional and alternative features, for example, to cover additional or fewer areas of the user's head 11, face 13 and neck 15, such as the user's ears 27.

With continuing reference to FIG. 1, the upper mask piece 14 has opposing (second) top and bottom edges 36 and 38, respectively, interconnecting opposing (second) front and back ends 40 and 42, respectively. Like the lower mask piece 12, the upper mask piece 14 includes an (second) attachment mechanism that is configured to attach the upper mask piece 14 to the user's head 11. As shown in FIG. 1, the second attachment mechanism includes one or more straps, namely a (second) crown strap 44 and a (second) neck strap 46. Each opposing end of the crown strap 44 is attached to a respective temple portion (one of which is visible in FIG. 1 at 48, but an identical counterpart is located on the opposite side of the user's head) of the upper mask piece 14 on opposite sides of the user's head 11. The crown strap 44, when properly situated, lies on top of the protector piece 16 and extends from the temple portions 48 over and around the crown of the user's head 11. In this regard, each opposing end of the neck strap 46 is attached to a respective cheek portion (one of which is visible in FIG. 1 at 50, but an identical counterpart is located on the opposite side of the user's head) of the upper mask piece 14 on opposite sides of the user's head 11. The neck strap 46, when properly situated, lies on top of the protector piece 16 and extends from the back end 42 of the upper mask piece 14 rearward and around the back of the user's neck 15. The crown and neck straps 44, 46 cooperatively ensure that the upper mask piece 14 will stay pressed against and properly situated on the central part of the user's face 13. Like the first attachment mechanism, the second attachment mechanism may comprise greater or fewer than two straps (see, e.g., FIG. 4), or may comprise other attachment means, such as buttons, bands, hook and loop fasteners, snap fasteners, alone or in any combination, without departing from the scope of this disclosure.

When properly situated on and attached to the user's head 11, the upper mask piece 14 extends across and covers at least a portion of the user's cheeks 21, the user's temples, and substantially all of the user's nose 31, including the tip and bridge but not the nostrils (as best seen with reference to FIGS. 2A-2C). Moreover, the upper mask piece 14 is configured to situate such that the portion of the bottom edge 38 that is proximate the user's mouth 25 sits on or above the user's top lip, which helps to ensure that the upper mask piece 14, like the lower mask piece 12, does not cover or obstruct the user's mouth 25. In the embodiment of FIG. 1, the upper mask piece 14 is also configured to situate on the user's face 13 such that at least the portion of the top edge 36 that is under the user's eyes 29 sits far enough below the eyes 29 so that the upper mask piece 14 does not impede the user's vision. The upper mask piece 14 may also take on various alternative shapes and sizes, and include a number of optional and alternative features, for example, to cover additional or fewer areas of the user's head 11 and face 13. With the disclosed design, the upper and lower mask pieces 14, 12 are separate, autonomous parts that are independently movable from one another. In so doing, the upper and lower mask pieces 14, 12 are individually repositionable on the user's head 11 and face 13.

An optional protector piece 16 may be provided to extend across and cover the user's head 11 and neck 15. In the embodiment illustrated in FIG. 1, the protector piece 16, when properly situated on the user, also extends across and covers a portion of the user's shoulders 17 and a portion of the face 13 (e.g., the user's forehead, ears and temples). The protector piece 16 of FIG. 1 includes a facial opening 58 that encircles part of the user's face 13 and provides a hole through which the user's chin 19, mouth 25, eyes 29, and nose 31 project. As will be discussed below, the protector piece 16 may take on various alternative shapes and sizes, and include a number of optional and alternative features, for example, to cover additional or fewer areas of the user's head 11, face 13 and neck 15.

FIGS. 2A-2C provide enlarged, alternative views of the nose area of the upper mask piece 14 of FIG. 1. The upper mask piece 14 includes a nose cup, designated generally as 52, that is shaped and sized to nest therein, extend across and cover the user's nose 31. The nose cup 52 includes a nostril flap 54, which extends underneath the nose 31 and covers some or all of the nasal columella 33, the exterior base-portion of the nose 31 between the nostrils 35, and some or all of the left and right ala nasi ridges 37, the exterior base-portions of the nose 31 adjacent the nostrils 35 of the nose 31. As best seen in FIG. 2A, the nostril flap 54 can include a contoured rear edge 56 that lies at least partially coterminous with (e.g., along the edges of) the nostrils 35.

Figure 3:
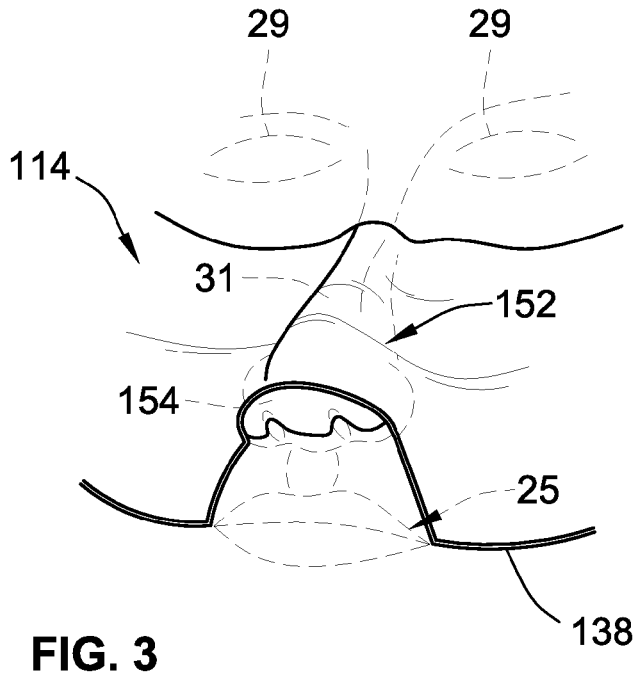
FIG. 3 is a perspective view illustration of an optional design for the nose area of an upper mask piece of a multi-piece face protector assembly in accordance with aspects of the present disclosure.

Some options, features and alternatives are presented in various forms in the following discussion and corresponding figures. These options and features, and other now known and hereinafter developed options and features, can be incorporated into any of the other disclosed embodiments, and vice versa, unless explicitly disclaimed or otherwise logically prohibited. FIG. 3 illustrates an optional design for the nose area of an upper mask piece 114 of a multi-piece face protector assembly. In this embodiment, the upper mask piece 114 includes a nose cup, designated generally as 152, that is shaped and sized to nest therein, extend across and cover the user's nose 31. The nose cup 152 includes a nostril flap 154, which extends underneath the nose 31 and covers all of the nasal columella 33 and all of the ala nasi ridges 37. The nostril flap 154 of FIG. 3 also partially covers, but does not significantly obstruct the user's nostrils 35. In contrast to the embodiment of FIG. 2C, the portions of the bottom edge 138 of the upper mask piece 114 that are on opposing sides of the user's mouth 25 are closer to the user's mouth to provide more covered surface area of the user's face 13.

Figure 4:
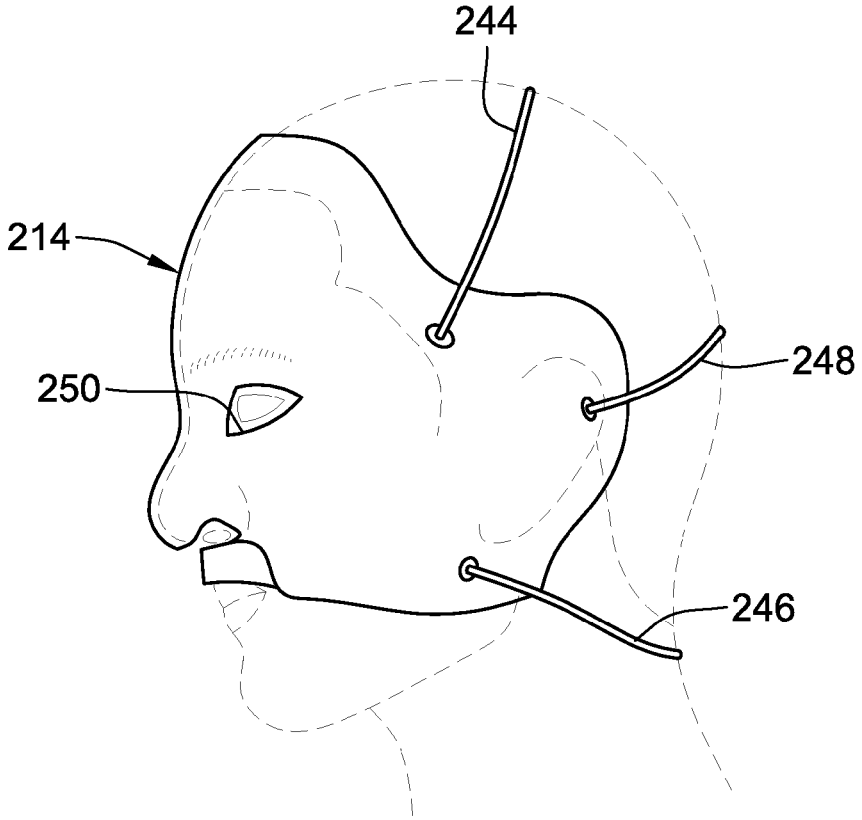
FIG. 4 is a side-view illustration of another optional design for the upper mask piece of a multi-piece face protector assembly in accordance with aspects of the present disclosure.

FIG. 4 is a side-view illustration of another optional design for an upper mask piece 214 of a multi-piece face protector assembly in accordance with aspects of the present disclosure. Like the other mask pieces disclosed herein, the upper mask piece 214 includes an attachment mechanism for securing the upper mask piece 214 to the user's head 11. As shown in FIG. 4, the attachment mechanism includes three elastomeric straps: a crown strap 244, a neck strap 246, and an occipital strap 248. The crown strap 244, when properly situated, extends over and around the crown of the user's head 11, while the neck strap 246, when properly situated, extends rearward and around the back of the user's neck 15, and the occipital strap 248, when properly situated, extends rearward and around the occipital portion of the skull. When properly positioned on the user's head 11, the upper mask piece 214 of FIG. 4, which is much larger than the version presented in FIG. 1, extends across and covers the user's cheeks 21, temples, ears 27, forehead, and substantially all of the user's nose 31, including the tip and bridge but not the nostrils. The upper mask piece 214 also covers a portion of the user's jaw 23, and the user's philtrum, which is the vertical groove of skin between the upper lip and nose. The upper mask piece 214 also includes two eye holes (one of which is visible in FIG. 4 at 250, but an identical counterpart is located on the opposite side of the user's nose) through which the user can see.

Figure 5:
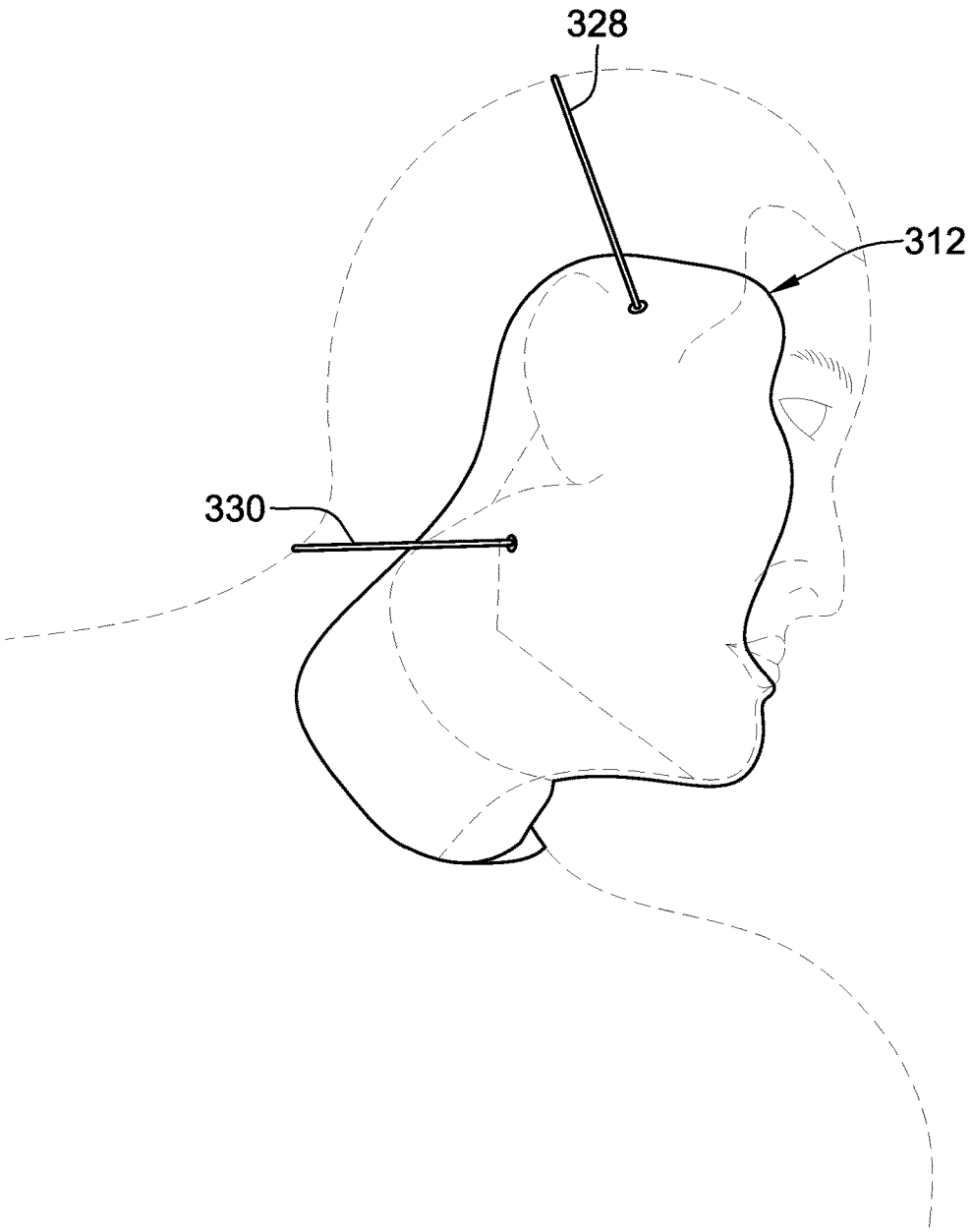
FIG. 5 is a side-view illustration of an optional design for the lower mask piece of a multi-piece face protector assembly in accordance with aspects of the present disclosure.

FIG. 5 is a side-view illustration of an optional design for a lower mask piece 312 of a multi-piece face protector assembly. Similar to the lower mask piece 12 set forth in FIG. 1, the lower mask piece 312 of FIG. 5 includes an attachment mechanism for securing the mask piece 312 to the head 11 of a user. This attachment mechanism, however, only includes two elastomeric straps: a crown strap 328 and a neck strap 330. The crown strap 328, which is similar to the crown strap 28 of FIG. 1, extends over and around the crown of the user's head 11. The neck strap 330, which is similar to the neck straps 30A-B of FIG. 1, extends rearward and around the back of the user's neck 15. When properly positioned on the user's head 11, the lower mask piece 312 of FIG. 5, which is much larger than the design presented in FIG. 1, extends across and covers the user's chin 19, cheeks 21, ears 27, temples, jaw 23, and the front portion of the user's neck 15.

Figure 6:
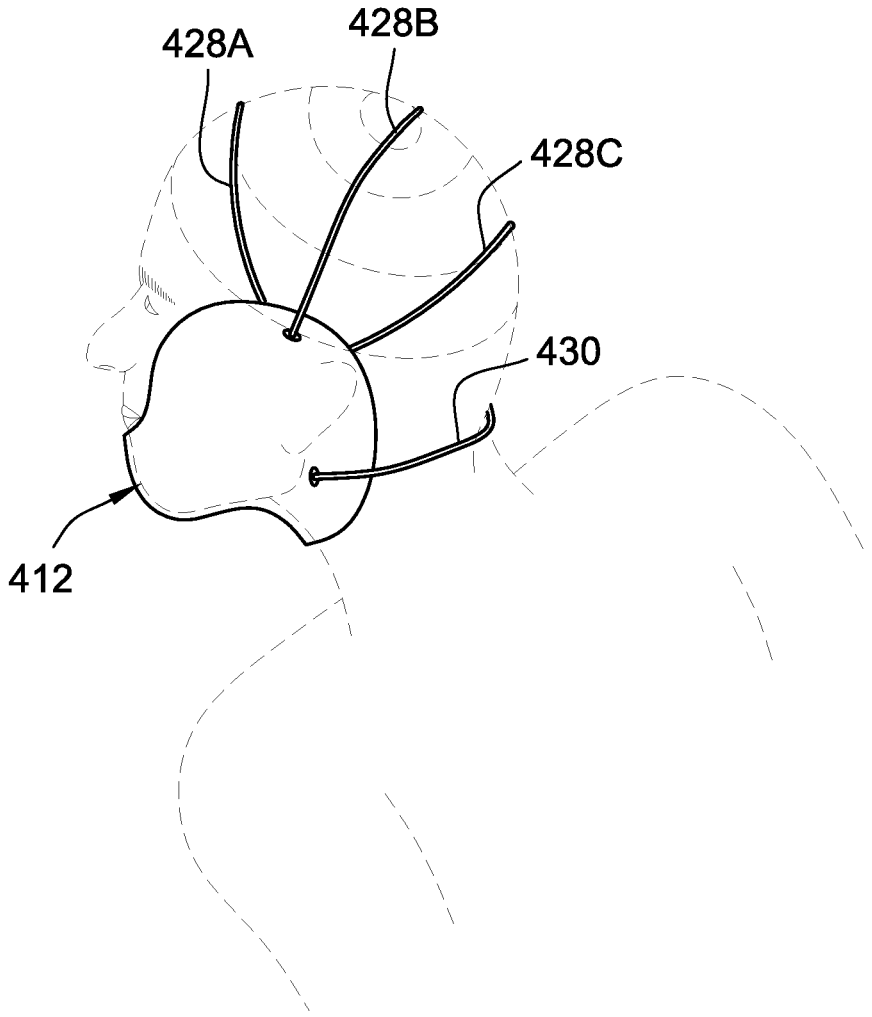
FIG. 6 is a perspective view illustration of another optional design for the lower mask piece of a multi-piece face protector assembly in accordance with aspects of the present disclosure.

FIG. 6 illustrates another optional design for a lower mask piece, designated generally at 412, of a multi-piece face protector assembly in accordance with aspects of the present disclosure. The lower mask piece 412 utilizes an attachment mechanism for securing the mask piece 412 to the user's head 11, the attachment mechanism including four elastomeric straps: three crown strap 428A, 428B and 428C and a neck strap 430. Circumferentially spaced from one another from the front to back along the user's head, the three crown straps 428A-C extend over and around the crown of the user's head 11. In contrast, the neck strap 430, which is similar to the neck straps 30A-B of FIG. 1, extends rearward and around the back of the user's neck 15. The lower mask piece 412 of FIG. 6, which is larger than the design presented in FIG. 1, extends across and covers the user's chin 19, cheeks 21, ears 27, temples, jaw 23, and a portion of the user's neck 15.

Figure 7:
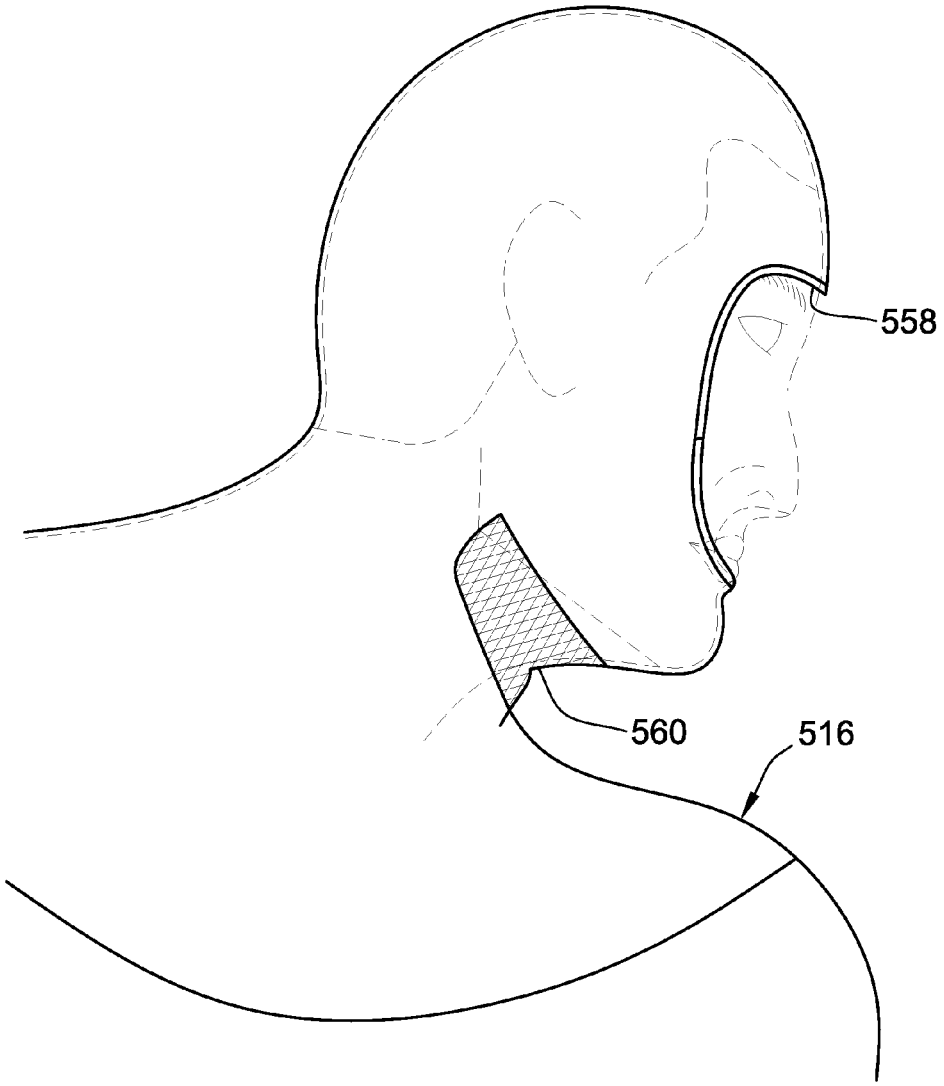
FIG. 7 is a perspective view illustration of a neck, head, and shoulder protector of a multi-piece face protector assembly in accordance with aspects of the present disclosure.
Figure 8:
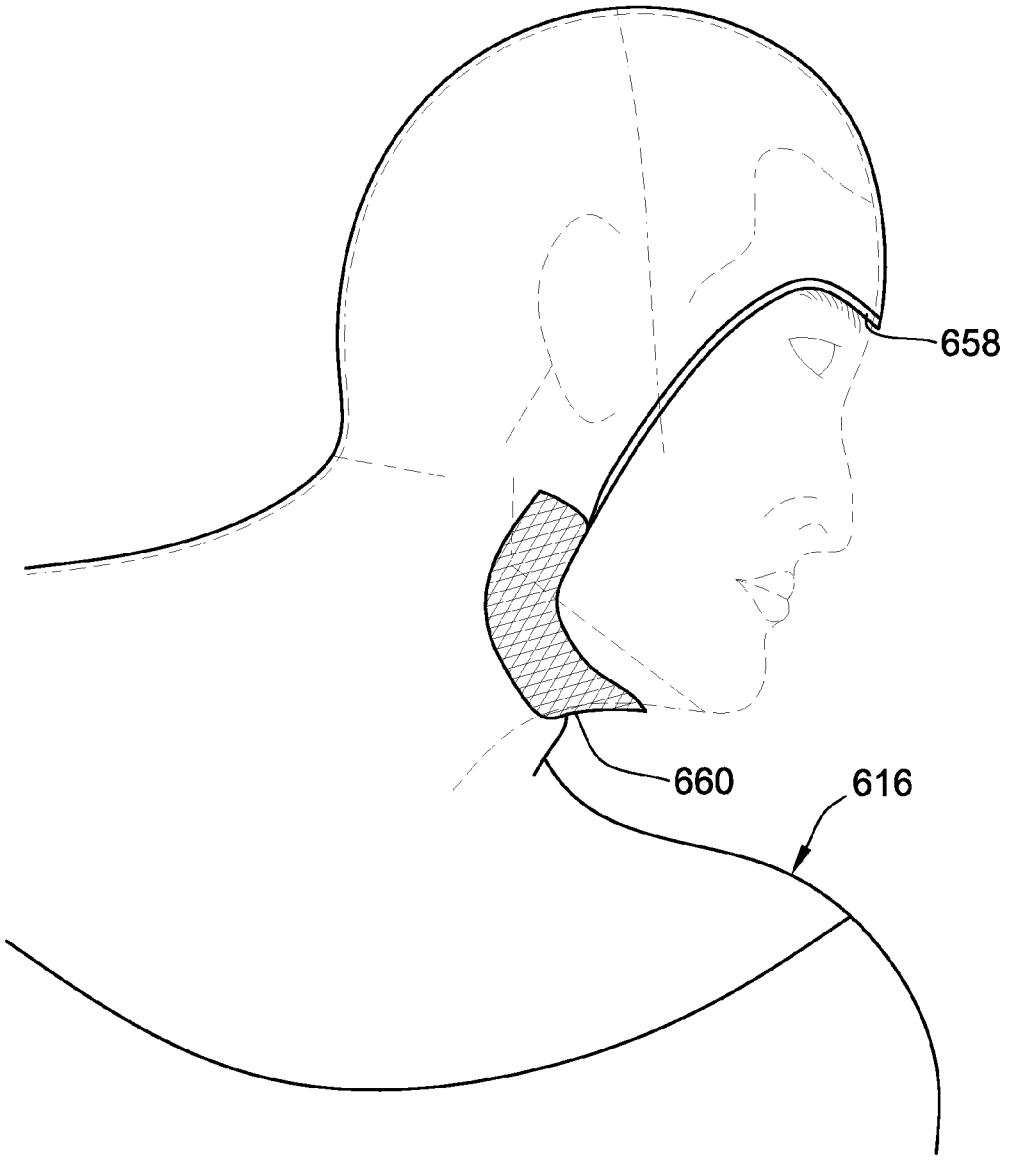
FIG. 8 is a perspective view illustration of another neck, head, and shoulder protector of a multi-piece face protector assembly in accordance with aspects of the present disclosure.

Turning now to FIGS. 7 and 8, there are provided two optional protector piece designs, respectively designated as 516 and 616, for a multi-piece face protector assembly. Comparable to the protector piece 16 of FIG. 1, the protector piece 516 of FIG. 7 and the protector piece 616 of FIG. 8 both extend across and covers the user's head 11, neck 15, and a portion of the user's shoulders 17. The protector piece 516 design presented in FIG. 7, however, also covers most of the user's face 13, including the user's forehead, cheeks, ears, jaw and temples. Contrastingly, the protector piece 616 of FIG. 8 covers only select portions of the user's face 13, including the user's forehead, ears, and temples. Like the protector piece 16 of FIG. 1, the protector piece 616 of FIG. 8 includes a facial opening 658 that encircles part of the user's face 13 and provides a hole through which the user's chin 19, mouth 25, eyes 29, and nose 31 project. In contrast, the facial opening 558 in the protector piece 516 of FIG. 7 encircles a smaller portion of the user's face 13 such that only the user's eyes 29, nose 31 and a portion of the user's mouth 25 are uncovered and exposed. Both protector pieces 516, 616 also include an optional region of increased elasticity 560 and 660, respectively, adjacent the user's neck 15. These regions 560, 660, by increasing the elasticity of the protector piece 516 around the front of the user's neck 15 underneath the jaw line, increase the mobility of the user's mouth and head.

Figure 9:
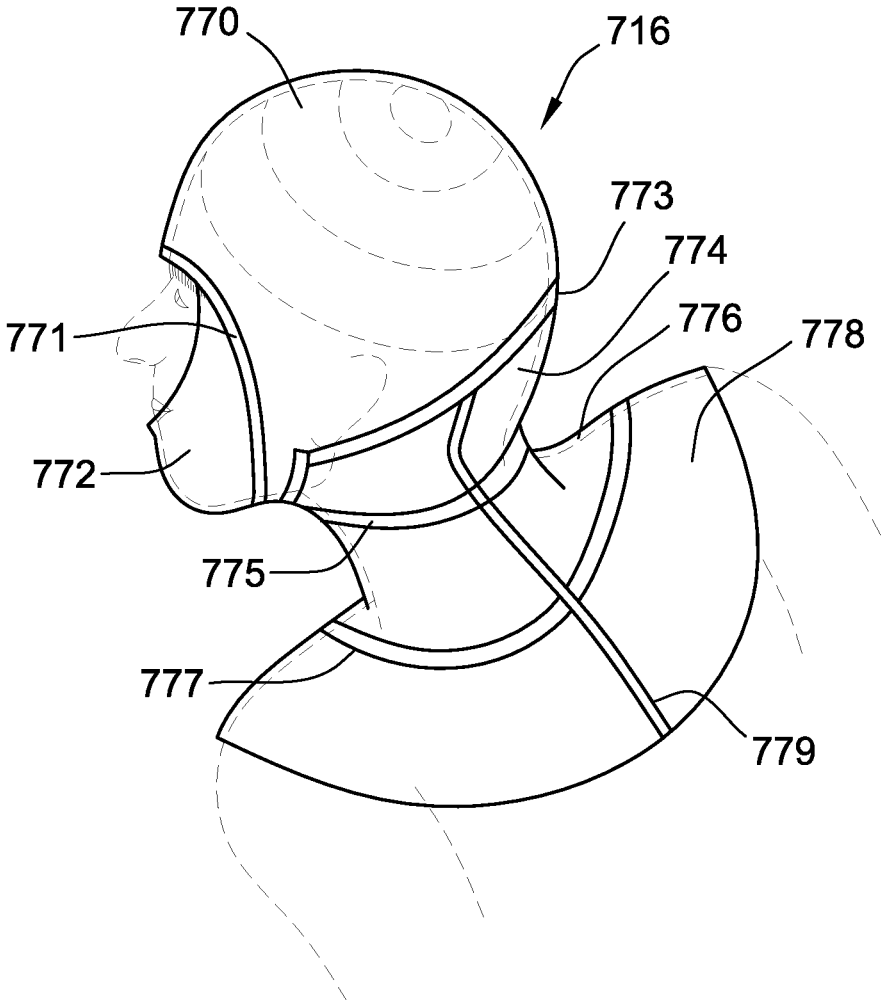
FIG. 9 is a perspective view illustration of a multi-piece face, neck, head, and shoulder protector of a multi-piece face protector assembly in accordance with aspects of the present disclosure.

FIG. 9 portrays a multi-segment protector piece construction 716 that can be used with any of the disclosed multi-piece face protector assemblies. The multi-segment protector piece 716, when fully assembled and properly positioned, as seen in FIG. 9, extends across and covers the user's head 11 and neck 15, a portion of the user's shoulders 17, and most of the user's face 13, including the user's forehead, cheeks, ears, jaw and temples. The multi-segment protector piece construction 716 includes a crown protector 770, a face protector 772, and upper neck protector 774, a lower neck protector 776 and a shoulder protector 778. Recognizably, the multi-segment protector piece 716 may comprise greater or fewer than the five components illustrated in FIG. 9.

In accord with the features of FIG. 9, the various components of the multi-piece protector piece assembly 716 are releasably attachable to one another such that the user can utilize any or all of the protector components at a given time. In particular, the face protector 772 is releasably attached to the crown protector 770 at a first seam region 771, while the upper neck protector 774 is releasably attached to the crown protector 770 at a second seam region 773. Likewise, the lower neck protector 776 is releasably attached along an upper edge to the upper neck protector 774 at a third seam region 775, and is releasably attached along a lower edge to the shoulder protector 778 at a fourth seam region 777. A fifth seam region 779 extends vertically up the center of the user's back, from the bottom of the shoulder protector 778, through the center of the upper and lower neck protectors 774, 776, to the second seam region 773 adjacent the crown protector 770. The fifth seam region 779 allows the shoulder protector 778 and neck protectors 774, 776 to be divided in half and wrapped around the user. Each of the seal regions comprises a fastening mechanism, such as a zipper, arrangement of buttons, or a hook and loop strip, to provide the requisite fastening capabilities. With this construction the user could decide to use only one or more select portions of the assembly 716. For instance, the user could use all of the protector pieces 770, 772, 774, 776, 778 or just the crown protector 770 and the upper and lower neck protectors 774, 776. The user could then decide to also use the face protector 772, which would merely require the user to join the face protector 772 to the crown protector 770 at the first seam region 771. Optionally, the user could then decide to remove the lower neck protector 776 at the third seam region 775, which would not require the removal of the other segments.

Figure 10:
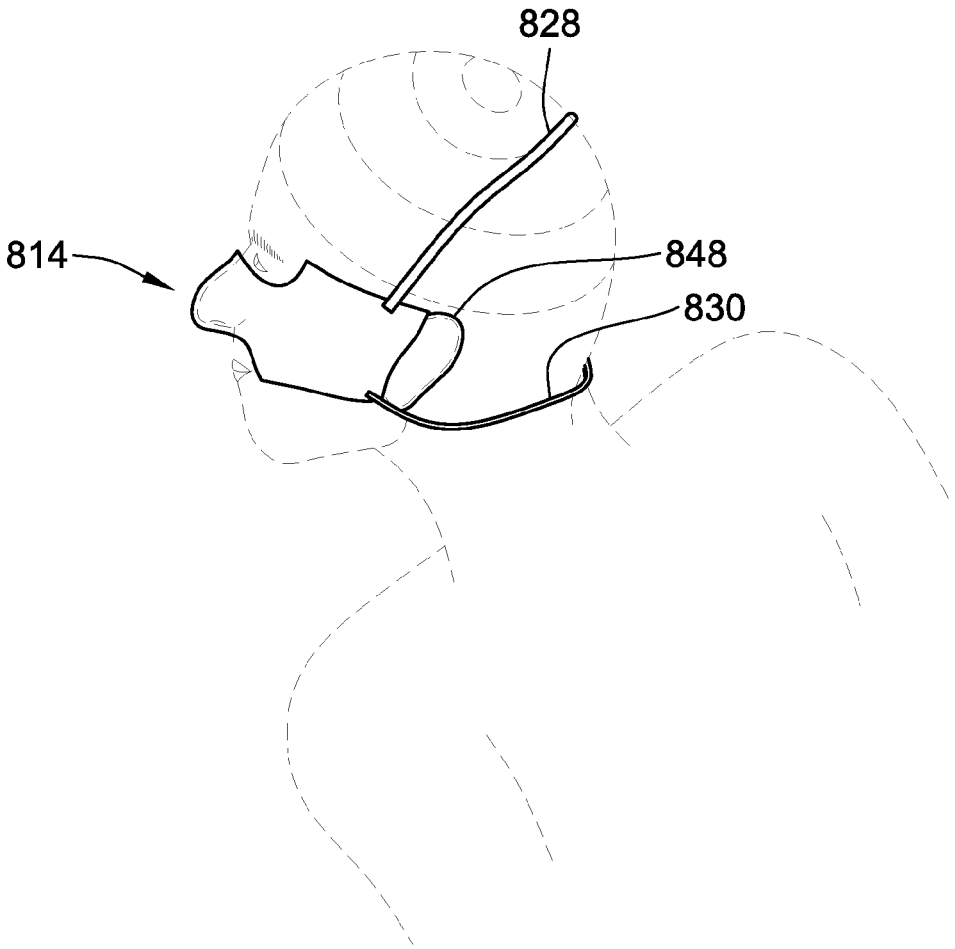
FIG. 10 is a perspective view illustration of another optional design for the upper mask piece of a multi-piece face protector assembly in accordance with aspects of the present disclosure, including neck and crown straps and ear loops for attachment to the user's head.

FIG. 10 is a perspective view illustration of another optional design for the upper mask piece of a multi-piece face protector assembly. Like the other mask pieces discussed above, the upper mask piece 814 includes an attachment mechanism for securing the upper mask piece 814 to the user's head 11. For this illustrated embodiment, the attachment mechanism includes four straps: a crown strap 828, a neck strap 830, and two ear-loop straps 848 (only one of which is visible in FIG. 10, but an identical counterpart is located on the opposite side of the user's head). The crown strap 828, when properly situated, extends over and around the crown of the user's head 11, while the neck strap 830, when properly situated, extends rearward and around the back of the user's neck 15. Each of the ear-loop straps 848 is elastic or otherwise configured to generally circumscribe the narrow segment of the user's ears 27. When properly positioned on the user's head 11, the upper mask piece 814 of FIG. 10, which is smaller than the version presented in FIG. 1, extends across and covers the user's cheeks 21 and temples, and substantially all of the user's nose 31, including the tip and bridge but not the nostrils.

Figure 11:
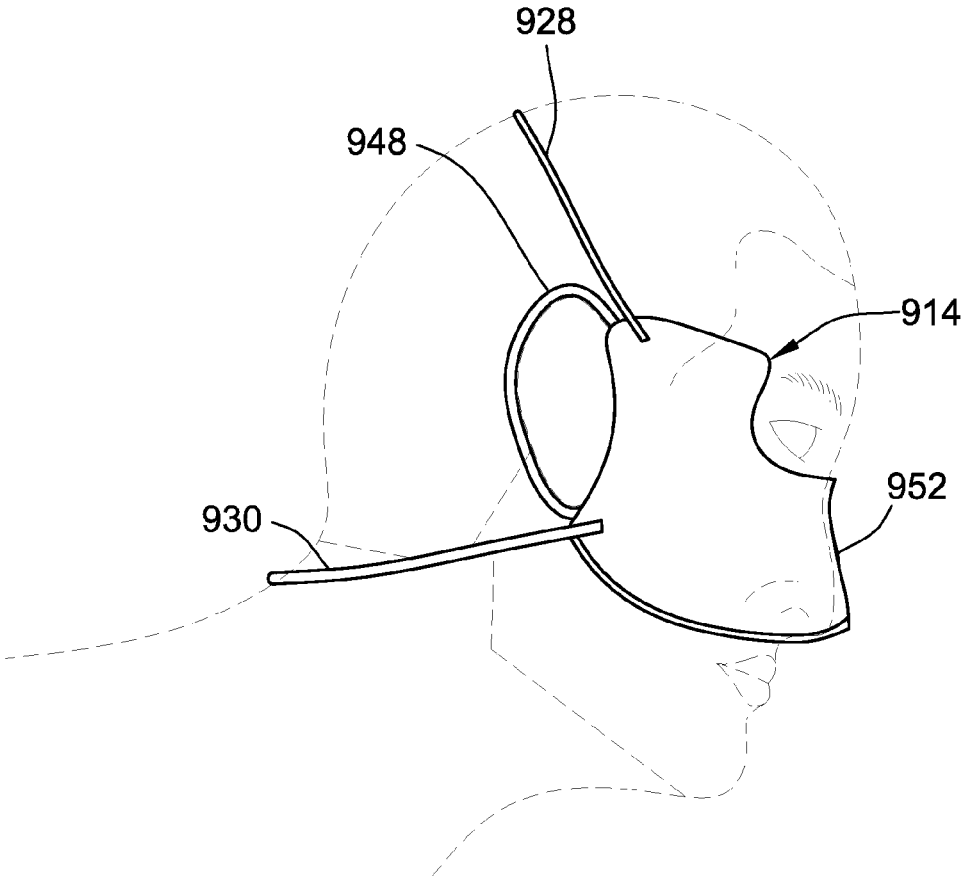
FIG. 11 is a side-view illustration of yet another optional design for the upper mask piece of a multi-piece face protector assembly in accordance with aspects of the present disclosure, including neck and crown straps and ear loops for attachment to the user's head.

Featured in FIG. 11 is an optional design for an upper mask piece 914 of a multi-piece face protector assembly in accordance with aspects of the present disclosure. Similar to the embodiment presented in FIG. 10, the upper mask piece 914 of FIG. 11 includes four straps for securing the upper mask piece 914 to the user's head 11: a crown strap 928, a neck strap 930, and two ear-loop straps 948 (only one of which is visible in FIG. 10, but an identical counterpart is located on the opposite side of the user's head). When properly positioned on the user's head 11, the upper mask piece 914 extends across and covers the user's cheeks 21, temples, and substantially all of the user's nose 31, including the tip and bridge but not the nostrils. In contrast to the upper mask piece 14 of FIG. 1, the upper mask piece 914 does not include a nose cup for cupping the user's nose, but rather includes a nose flap 952 that extends across and blankets the user's nose 31.

Figure 12:
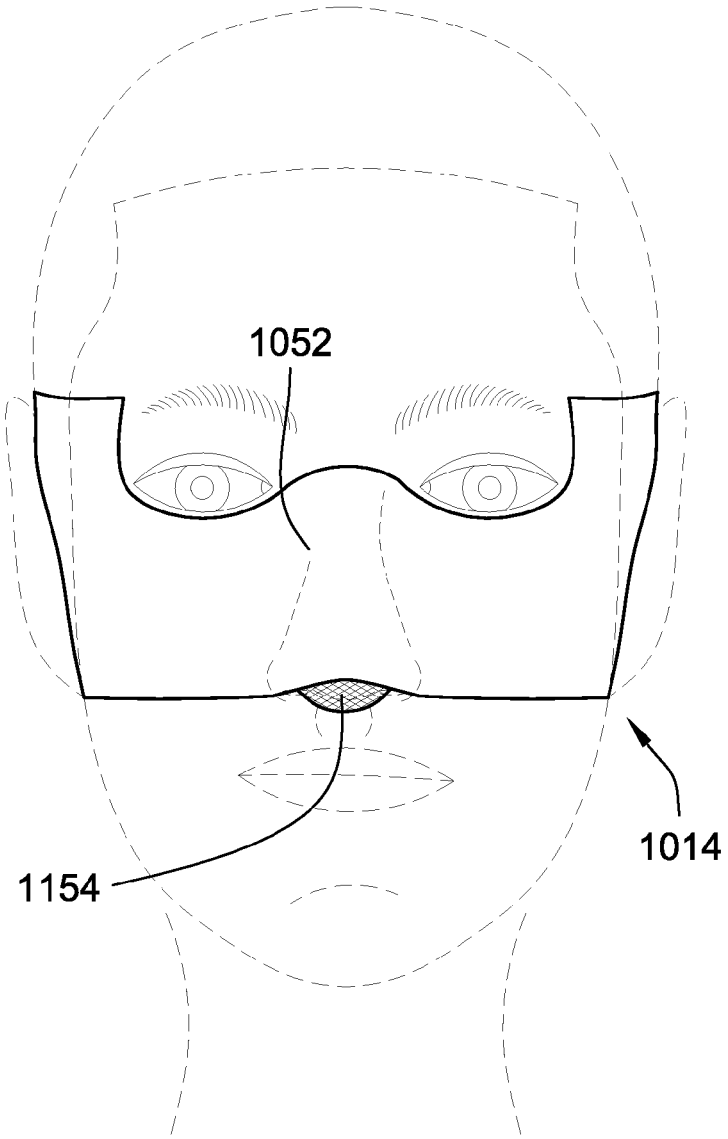
FIG. 12 is a front-view illustration of an additional optional design for the upper mask piece of a multi-piece face protector assembly in accordance with aspects of the present disclosure.
Figure 13:
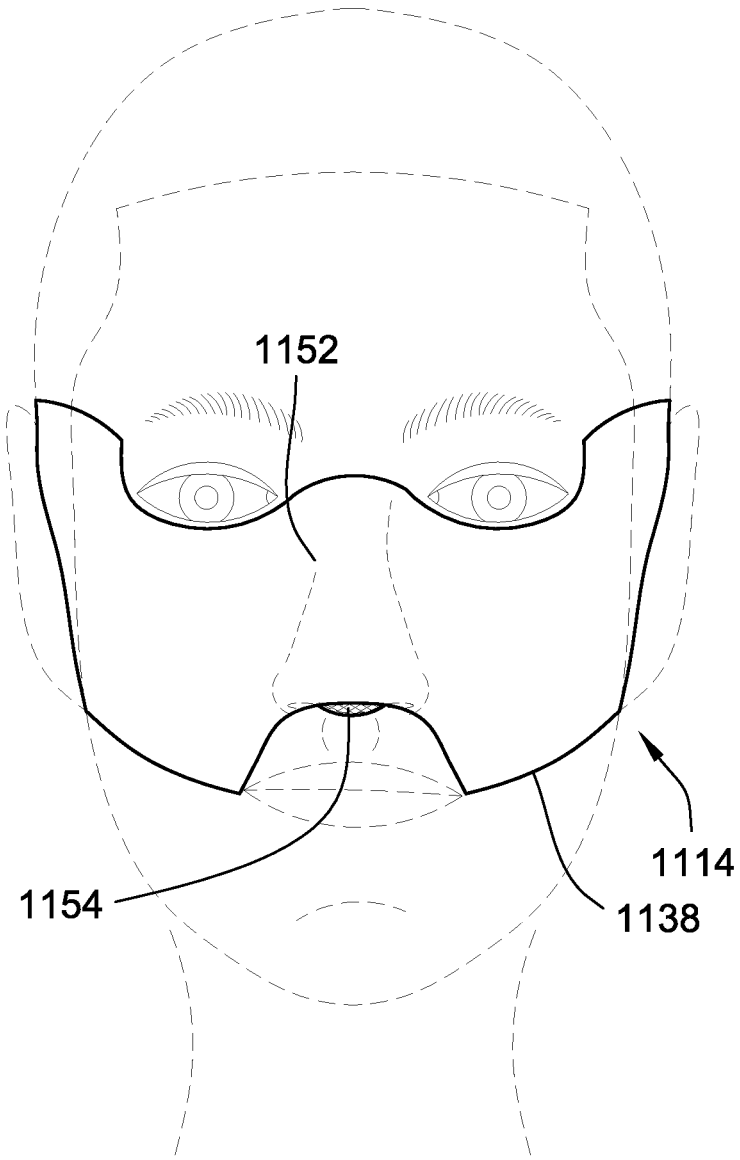
FIG. 13 is a front-view illustration of even yet another optional design for the upper mask piece of a multi-piece face protector assembly in accordance with aspects of the present disclosure.

FIGS. 12 and 13 also provide various design options for an upper mask piece of a multi-piece face protector assembly. The upper mask piece 1014 of FIG. 12, like the example provided in FIG. 11, does not include a nose cup for cupping the user's nose, as seen in FIGS. 2A-C, but rather includes a nose flap 1052 that extends across and blankets the user's nose 31. The nose flap 1052 portrayed in FIG. 12 includes a nostril shield 1054 that extends underneath the nose 31 and protects the nasal columella 33 and the ala nasi ridges 37. Similarly, the upper mask piece 1114 of FIG. 13 includes a nose flap 1052 that extends across and blankets the user's nose 31. In contrast to the configuration of FIG. 12, the nose flap 1152 portrayed in FIG. 13 includes a smaller nostril shield 1154 that extends underneath the nose 31. In addition, the portions of the bottom edge 1138 of the upper mask piece 1114 that are on opposing sides of the user's mouth 25 are closer to the user's mouth to provide more covered surface area of the user's face 13.

Figure 14:
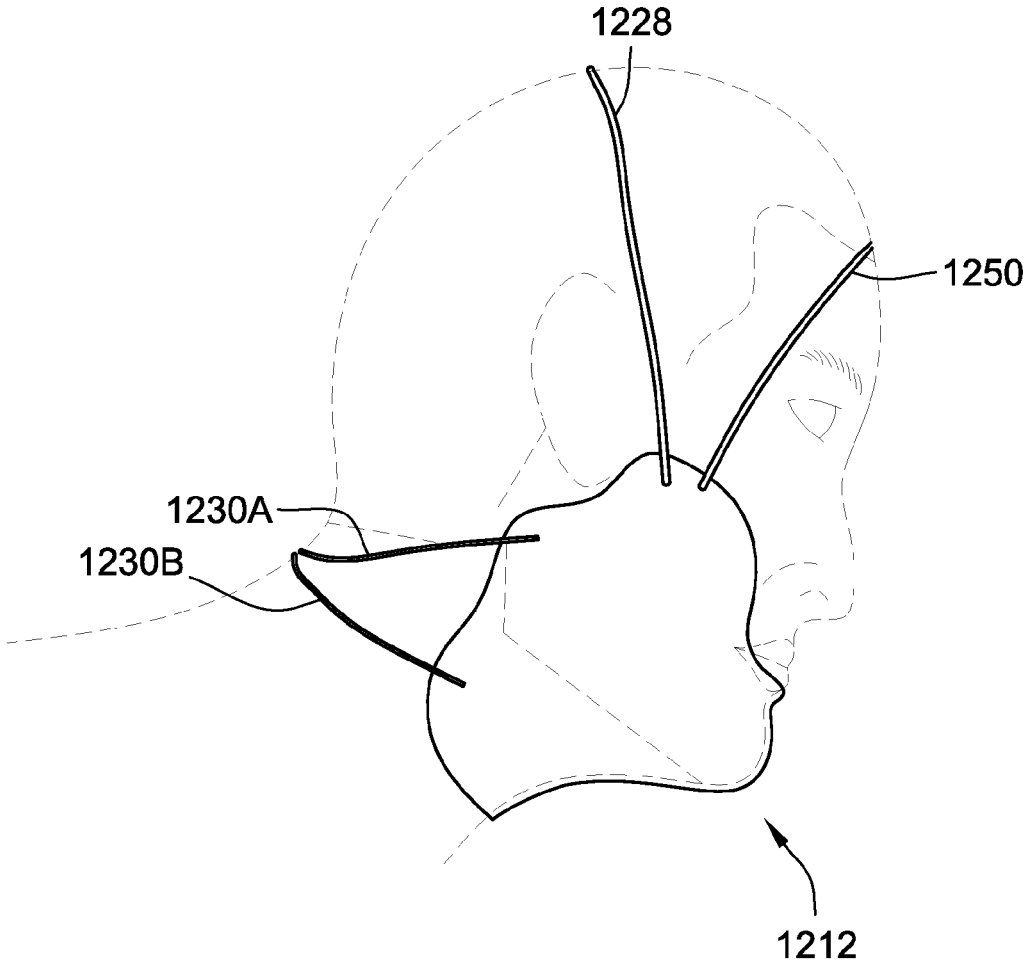
FIG. 14 is a side-view illustration of another optional design for the lower mask piece of a multi-piece face protector assembly in accordance with aspects of the present disclosure.

FIG. 14 illustrates yet another optional design for a lower mask piece, designated generally at 1212, of a multi-piece face protector assembly. The lower mask piece 1212 utilizes four elastomeric straps for securing the mask piece 1212 to the user's head 11: a crown strap 1228, two neck straps 1230A and 1230B, and a forehead strap 1250. The crown strap 1228, which is similar to the crown strap 28 of FIG. 1, extends over and around the crown of the user's head 11. The neck straps 1230A, 1230B, which are similar to the neck straps 30A-B of FIG. 1, extend rearward and around the back of the user's neck 15. The forehead strap 1250, in contrast, extends up and around the top of the user's forehead.

Figure 16:
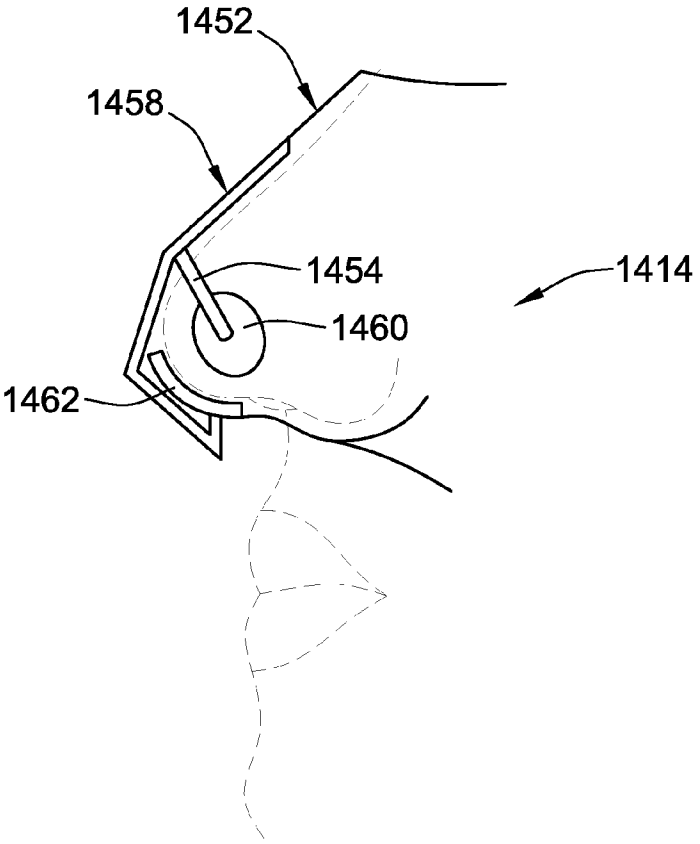
FIG. 16 is a perspective view illustration of another optional nose cup design with moldable elements for fitting the nose area of an upper mask piece around the nose in accordance with aspects of the present disclosure.
Figure 15:
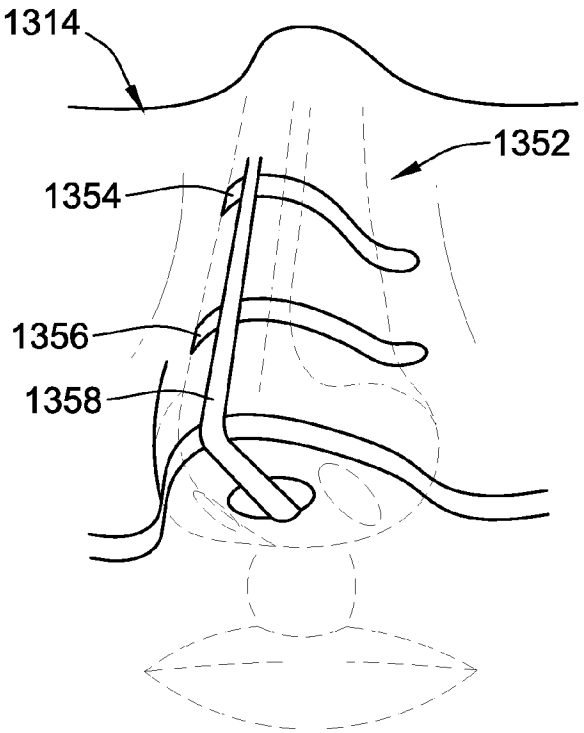
FIG. 15 is a perspective view illustration of an optional nose cup design with moldable elements for fitting the nose area of an upper mask piece around the nose in accordance with aspects of the present disclosure.

FIGS. 15 and 16 are illustrations of optional nose cup designs with moldable elements for fitting the nose area of an upper mask piece around the user's nose. In FIG. 15, the upper mask piece 1314 includes a nose cup, designated generally as 1352, that is shaped and sized to nest therein, extend across and cover the user's nose 31. Likewise, the upper mask piece 1414 includes a nose cup, designated generally as 1452 in FIG. 16, that is shaped and sized to nest therein, extend across and cover the user's nose 31. Each of the nose cups 1352, 1342 includes one or more moldable elements configured to be bent or otherwise molded to the contours of the user's nose to thereby fit the nose cup 1352, 1342 to the individual contours of a user's nose. By way of non-limiting example, the nose cup 1352 of FIG. 15 includes first and second moldable ribs 1354 and 1356 that are interconnected by a moldable spine 1358. The moldable ribs 1354, 1356 extend laterally across the bridge of the nose (e.g., the dorsom), while the moldable spine 1358 extends vertically along the longitudinal length of the bridge, from the top of nose down and under the columella. As another example, the nose cup 1452 of FIG. 16 includes a single moldable rib 1454 that is connected to a moldable spine 1458. The moldable ribs 1454 extends laterally across the upper portion of the tip of the nose, while the moldable spine 1458 extends vertically along the longitudinal length of the bridge of the nose. The moldable rib 1454 and spine 1458 both include pads 1460 and 1462, respectively, for cupping the nose.

Figure 17:
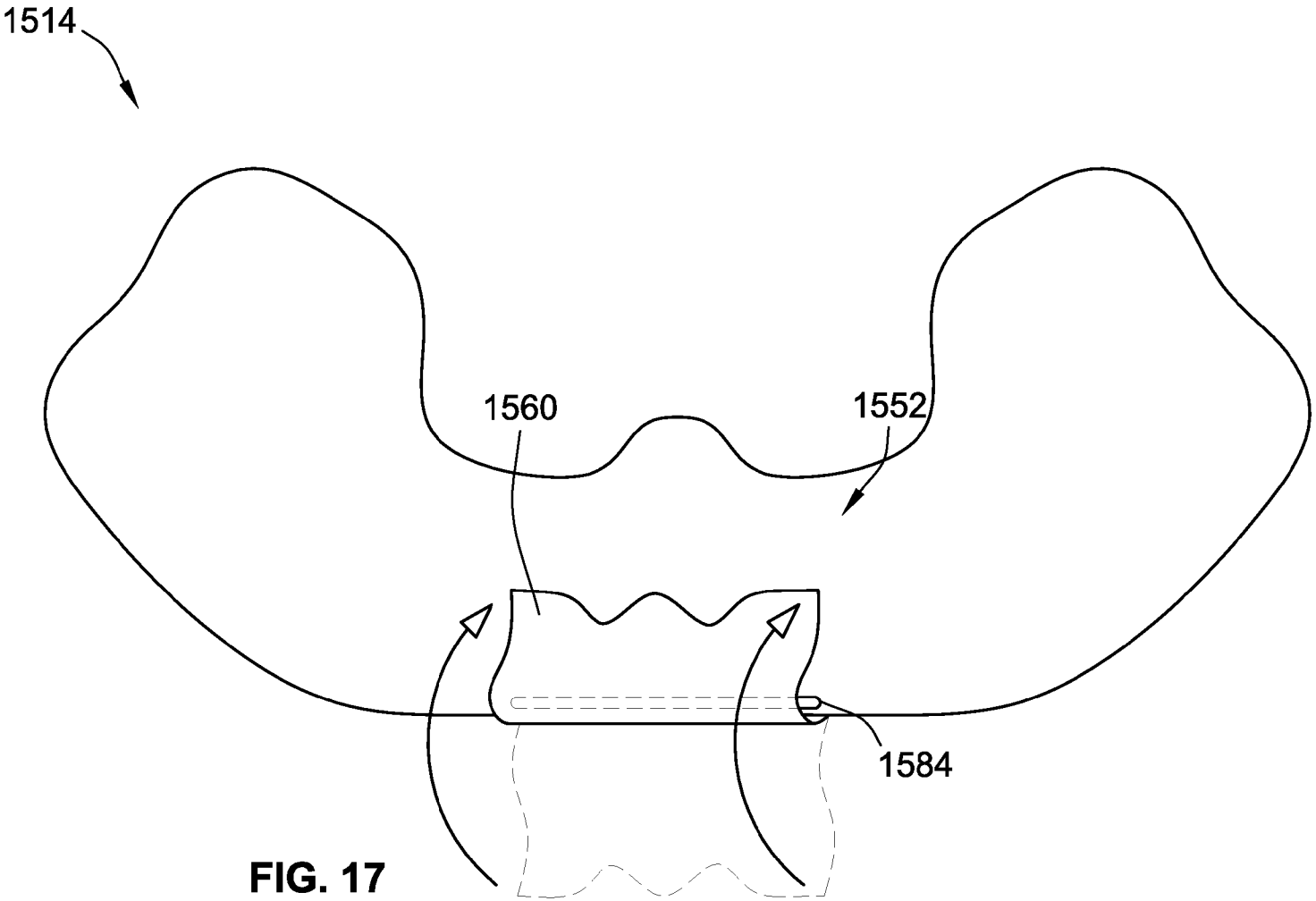
FIG. 17 is a front-view illustration of yet another optional design for the upper mask piece of a multi-piece face protector assembly in accordance with aspects of the present disclosure, including a fabric extension that, when folded, creates a nose pocket, and a moldable strip enclosed with the nose pocket to create a moldable nose pocket.
Figure 18:
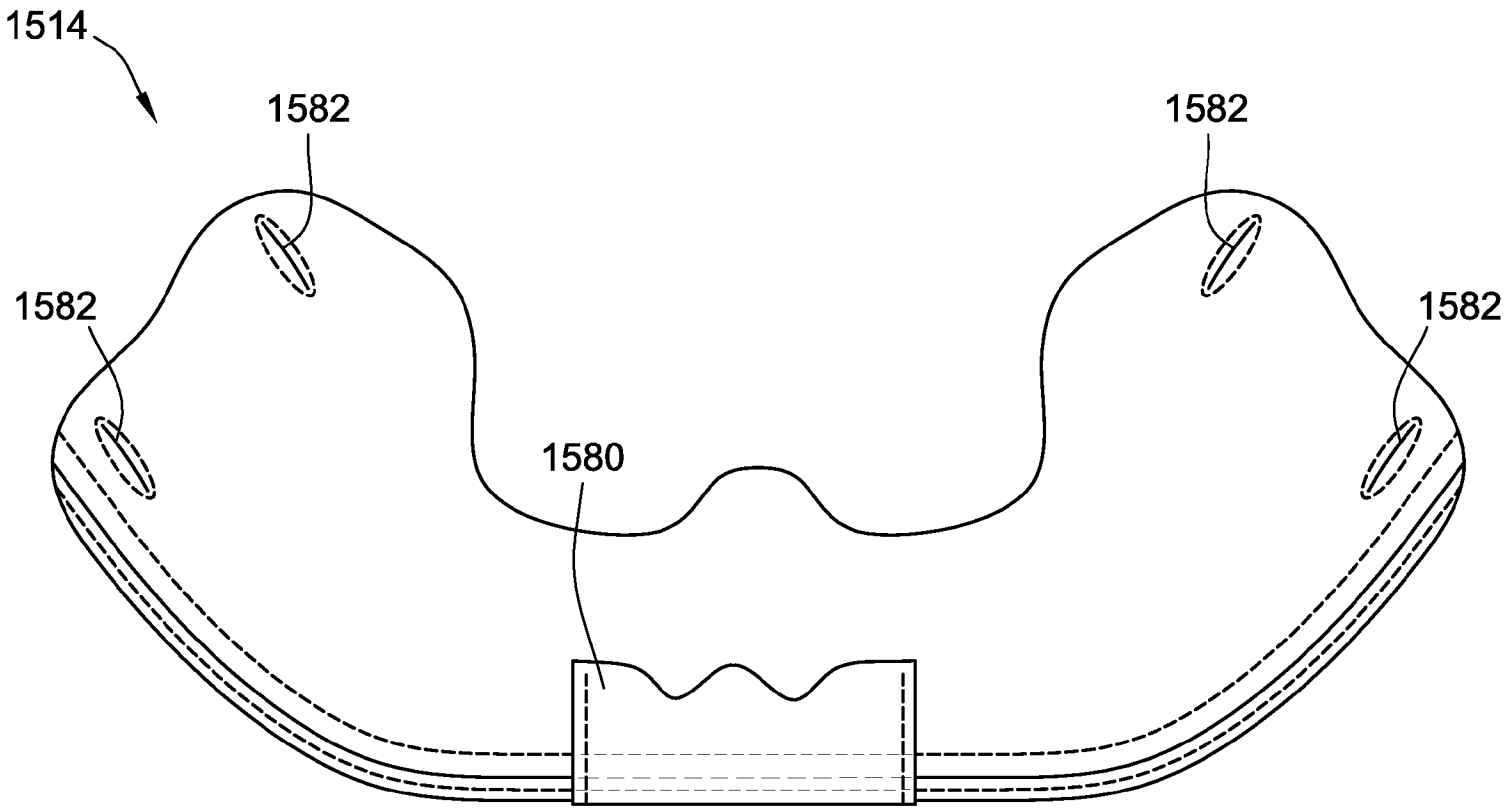
FIG. 18 is a front-view illustration of the upper mask piece of FIG. 17, showing the fabric nose pocket after the fabric extension has been stitched into place, an arrangement of button holes in the cover material, and a moldable component sewn between two rows of stitching along the bottom edge of the upper mask piece and enclosed in binding.

FIGS. 17 and 18 of the drawings provide additional design options for an upper mask piece 1514 that may be incorporated into any of the multi-piece face protector assemblies disclosed herein. In accord with this example, the upper mask piece 1514 includes a fabric extension 1580 that, when folded, creates a nose pocket 1552. A moldable strip 1584 may be enclosed within the nose pocket 1552 to create a moldable nose pocket that can be bent or otherwise formed to the contours of a user's nose. FIG. 18 shows the upper mask piece 1514 after the fabric extension 1580 has been stitched into place to form the fabric nose pocket 1552. The upper mask piece 1514 has also been provided with an arrangement of button holes 1582 formed into the cover material which can be used for attaching the upper mask piece 1514 to a complementary lower mask piece and/or a complementary protector piece. The moldable strip 1584 has sewn between two rows of stitching along the bottom edge of the upper mask piece and enclosed in binding.

Figure 19:
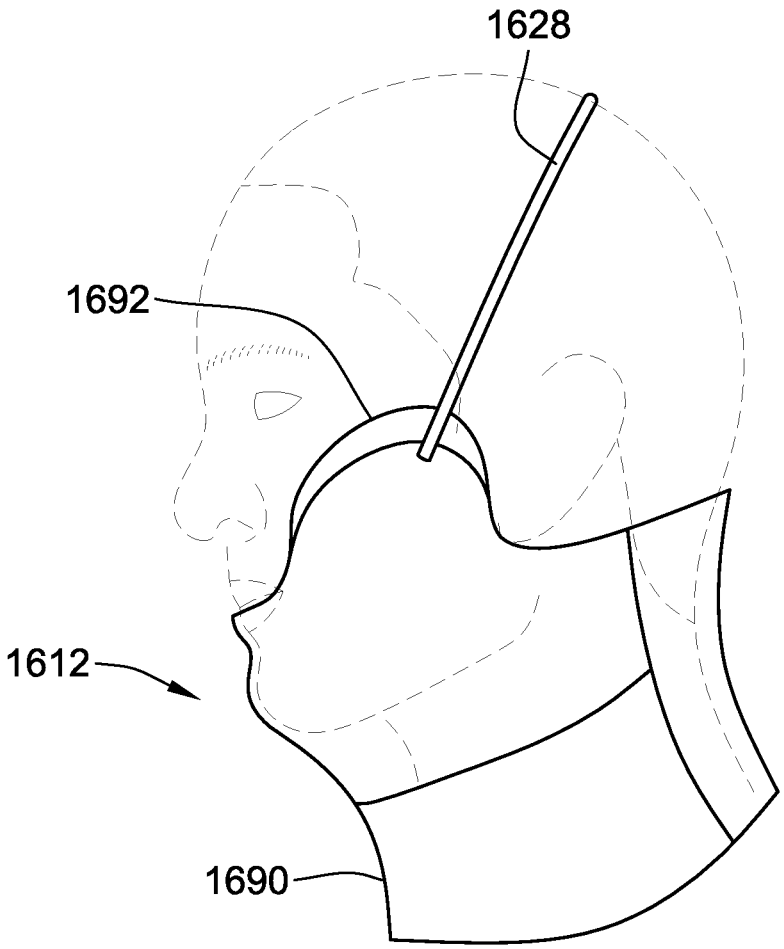
FIG. 19 is a side-view illustration of another optional design for the lower mask piece of a multi-piece face protector assembly in accordance with aspects of the present disclosure, including a neck gaiter portion and a strap over the crown of the head to keep the cheek covering portion in place and to suspend the neck gaiter reliably in the same place.
Figure 20:
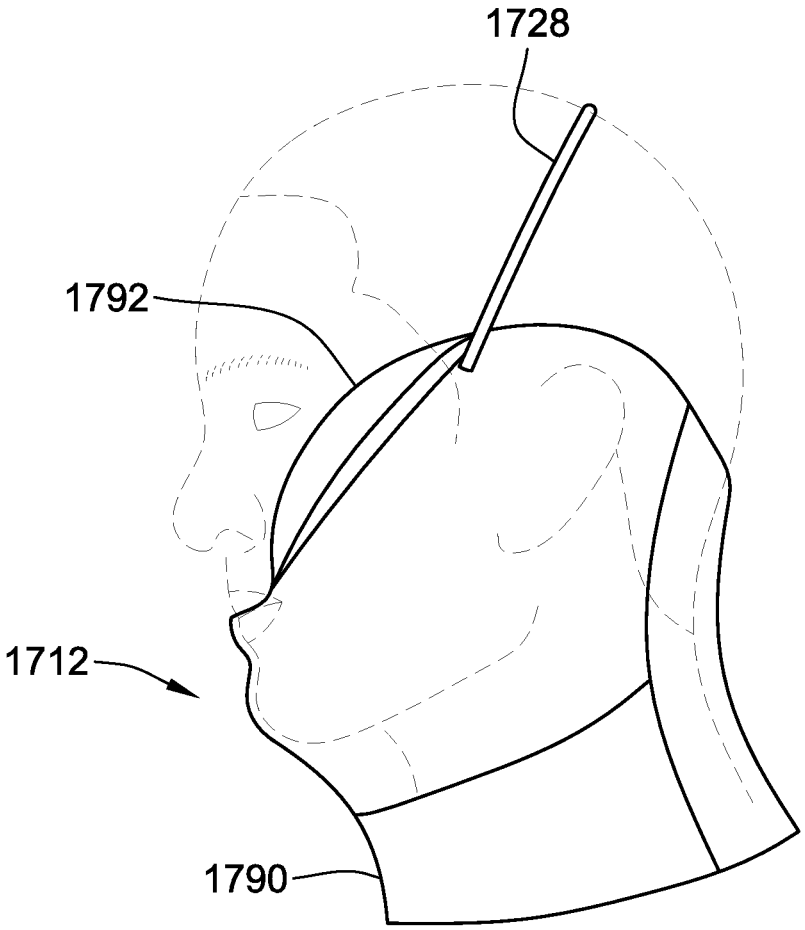
FIG. 20 is a side-view illustration of another optional design for the lower mask piece of a multi-piece face protector assembly in accordance with aspects of the present disclosure, including a neck gaiter portion, a strap over the crown of the head, and ear covering portions.

Turning next to FIG. 19, there is shown another optional design for a lower mask piece 1612 of a multi-piece face protector assembly. In the example shown, the lower mask piece 1612 includes an elongated, tubular neck gaiter portion 1690 that hangs down and around the user's neck. The lower mask piece 1612 also includes cheek covers 1692 on each side of the user's head. A crown strap 1628 is provided for attaching the lower mask piece 12 to the head 11 of a user, and to keep the cheek covers 1692 in place and to suspend the neck gaiter portion 1690 reliably in the same place. FIG. 20 is a side-view illustration of another optional lower mask piece 1712 which also includes a neck gaiter portion 1790, cheek covers 1792, and a crown strap 1728. By way of comparison to FIG. 19, the lower mask piece 1712 of FIG. 20 is longer so that it may cover, in addition to the user's neck, jaw and cheeks, the user's ears and the back of the user's head. In both of these designs, the lower mask pieces 1612, 1712 cover the user's bottom lip. Notice, however, that the user's mouth is not obstructed by the lower mask pieces 1612, 1712.

Figures 21A, 21B, 21C:
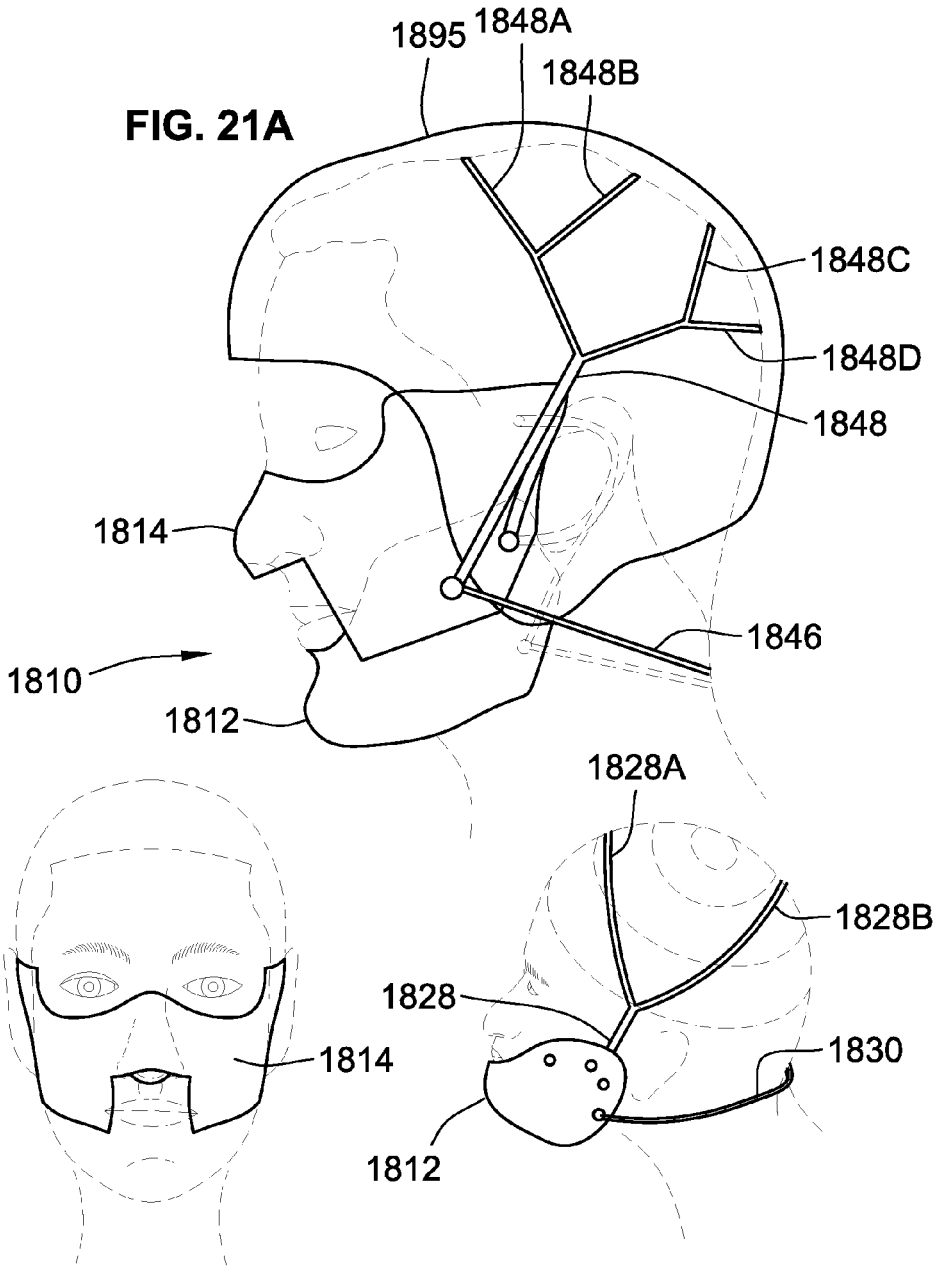
FIGS. 21A-C are a series of alternative views of a multi-piece face protector assembly in accordance with aspects of the present disclosure being used with a helmet.

FIG. 21A presents a multi-piece face protector assembly, collectively designated as 1810, in accordance with aspects of the present disclosure. The face protector assembly 1810 is a multi-piece assembly including two attachable and independently movable pieces, namely a lower mask piece 1812 and an upper mask piece 1814. Both the lower and the upper mask pieces 1812, 1814 include a respective attachment mechanism for attaching the mask piece to the head 11 of a user. As shown in FIG. 21C, the attachment mechanism of the lower mask piece 1812 includes a neck strap 1830 and a crown strap 1828 with two suspension arms 1828A and 1828B that each extends over and around a respective portion of the crown of the user's head underneath a helmet 1895. Likewise, the upper mask piece 1814 includes a neck strap 1846 and a crown strap 1848 with four suspension arms 1848A, 1848B, 1848C and 1848D that each extends over and around a respective portion of the crown of the user's head.

Figure 22A:
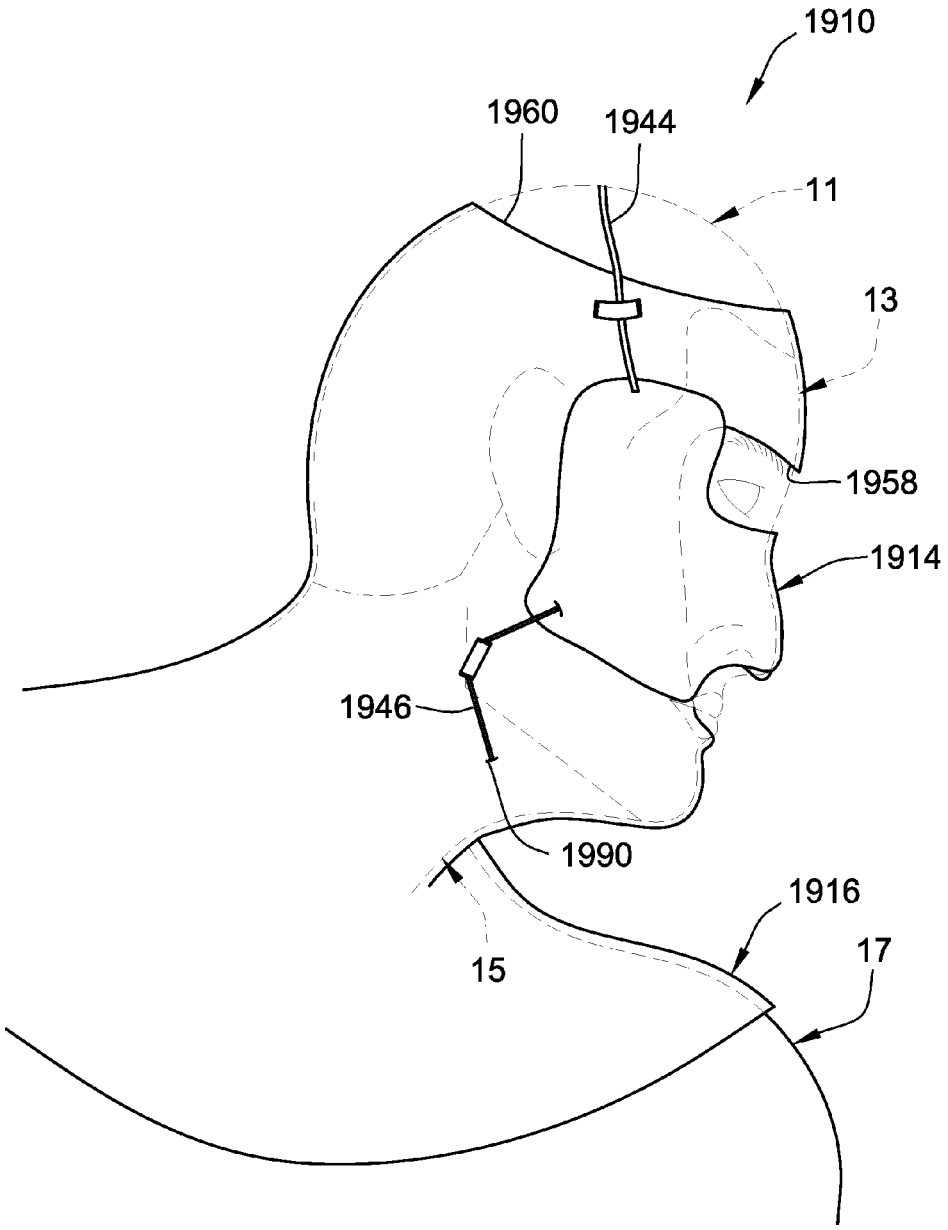
FIGS. 22A and 22B are side-view illustrations of an alternative multi-piece face protector assembly in accordance with aspects of the present disclosure.
Figure 22B:
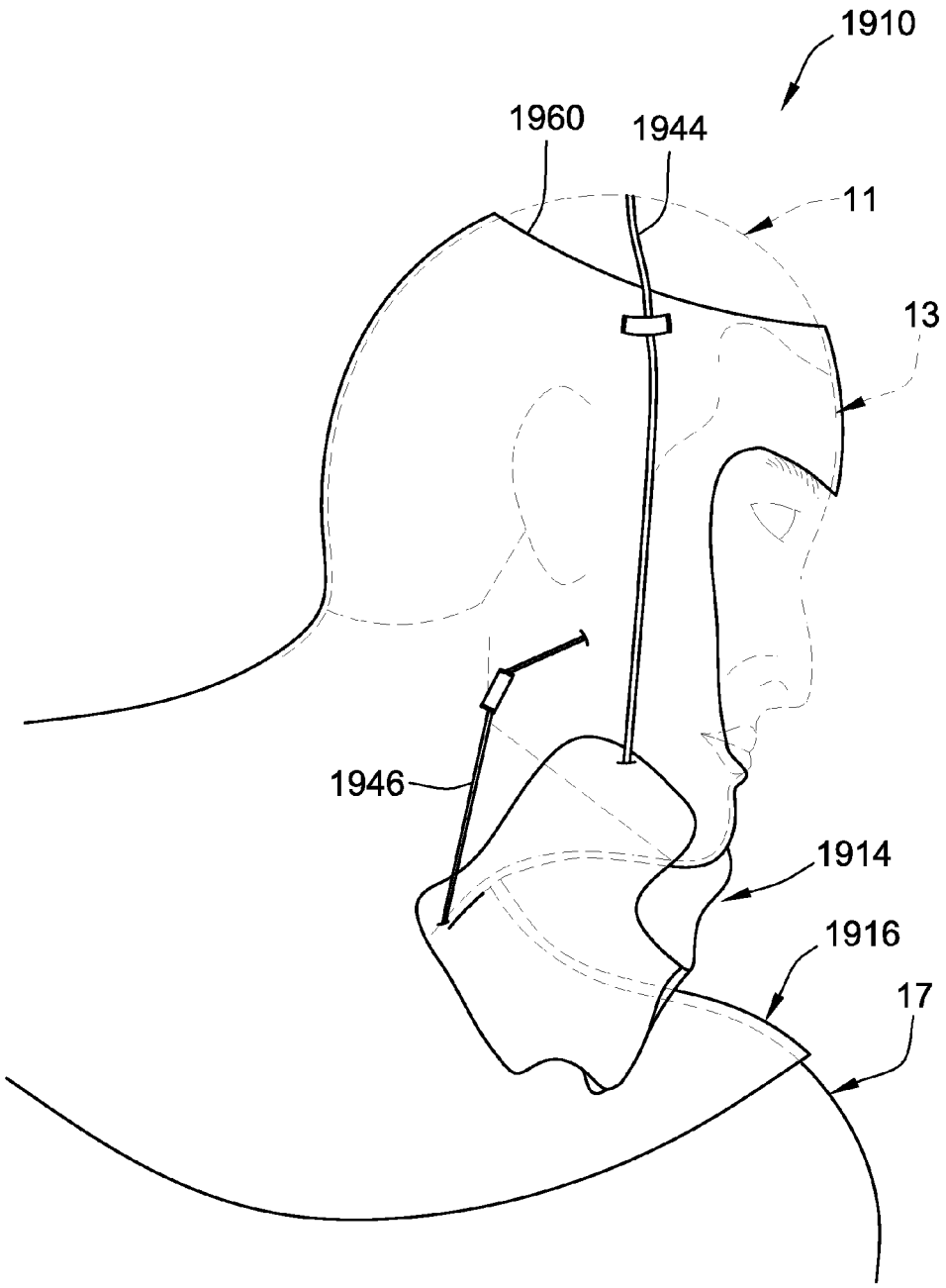

There is shown in FIGS. 22A and 22B another representative face protector assembly, designated generally as 1910, in accordance with aspects of the present disclosure. In the illustrated embodiment, the face protector assembly 1910 includes two primary components: an upper mask piece 1914 and a protector piece 1916. The upper mask piece 1914 includes an attachment mechanism for properly securing the mask piece 1914 to the user's head 11. This attachment mechanism comprises two straps: a crown strap 1944 and a neck strap 1946. Like the crown strap 44 of FIG. 1, the crown strap 1944 of FIGS. 22A-B lies on the outside of the protector piece 1916, extending over and around the crown of the user's head 11. In contrast to the neck strap 46 of FIG. 1, which lies on top of the protector piece 16, the neck strap 1946 of FIGS. 22A-B passes into and out of the protector piece 1916 through a pair of spaced holes 1990 (only one of which is visible in FIG. 22A, but an identical counterpart is located on the opposite side of the user's neck), extending forward and around the front of the user's neck 15.

When properly situated on and attached to the user's head 11, the upper mask piece 1914 extends across and covers the user's cheeks and temples, and substantially all of the user's nose 31, including the tip and bridge, but not the nostrils. By way of comparison, the protector piece 1916, when properly situated on the user, extends across and covers the user's head 11 and neck 15, a portion of the user's shoulders 17 and a portion of the face 13, including the user's jaw, forehead, cheeks, ears and temples. The crown of the user's head is exposed by the protector piece 1916, for example, via a circular crown opening 1960. The protector piece 1916 of FIGS. 22A-B includes a facial opening 1958 that encircles a small portion of the user's face 13, providing a hole through which projects the user's eyes 29 and nose 31 and a portion of the user's mouth 25. With the disclosed design, the face mask pieces 1914 and 1916 are separate, autonomous parts that are independently movable from one another. In so doing, the upper mask piece 1914 is independently repositionable on the user's head 11 and face 13, as seen in FIG. 22B.

Figure 23A:
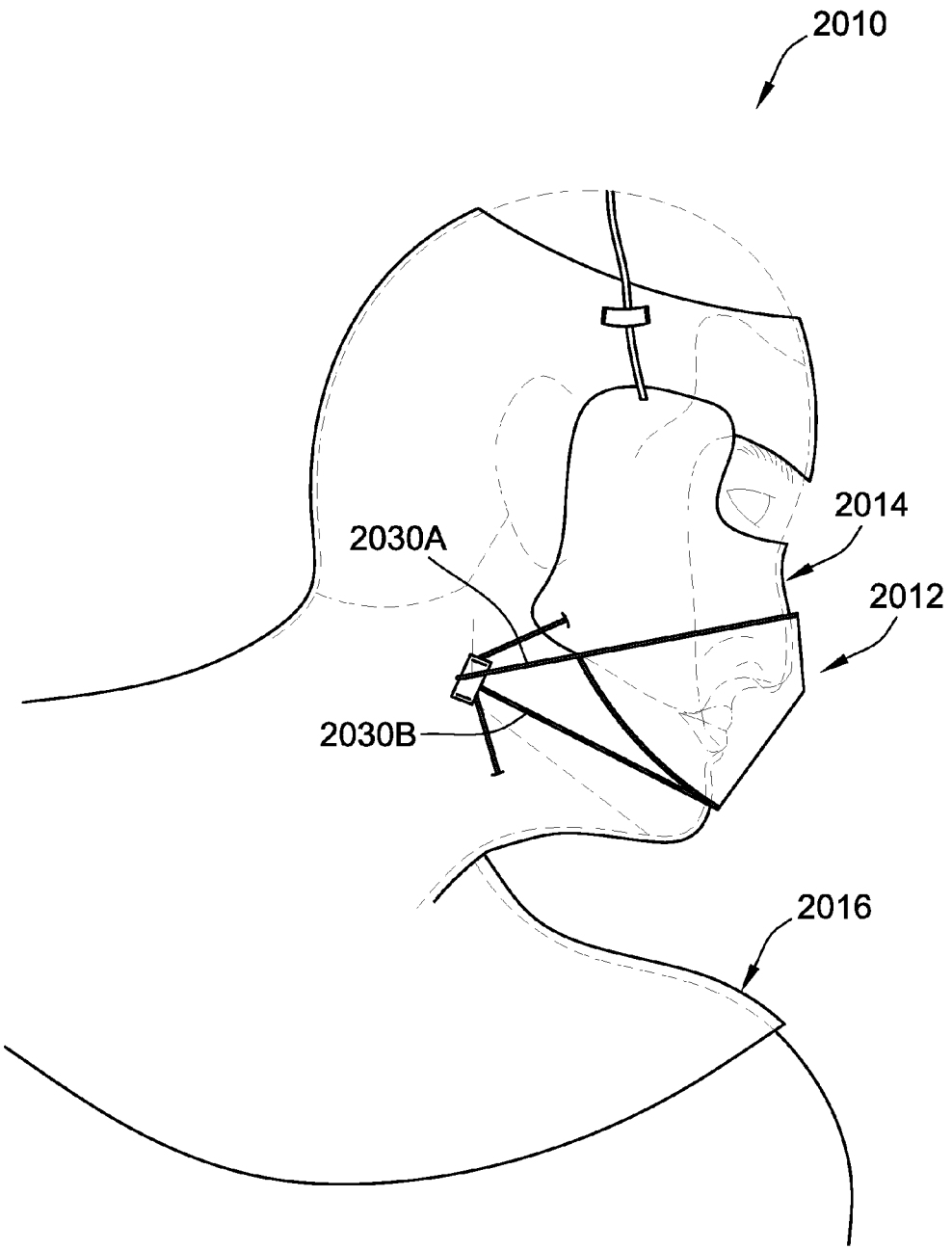
FIGS. 23A and 23B are side-view illustrations of another alternative multi-piece face protector assembly in accordance with aspects of the present disclosure.
Figure 23B:
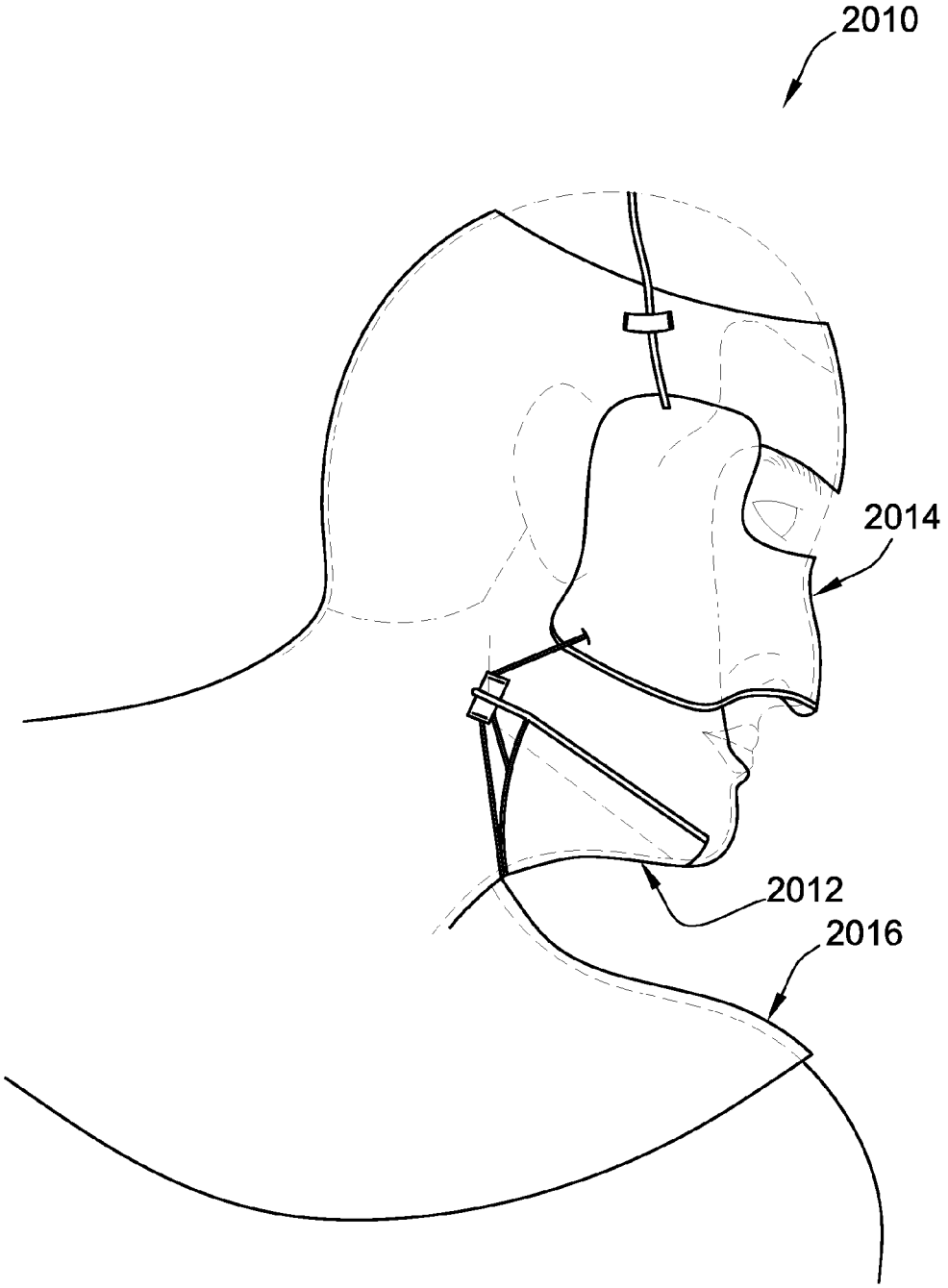

FIGS. 23A and 23B illustrate another representative face protector assembly, designated generally as 2010, in accordance with aspects of the present disclosure. In the illustrated embodiment, the face protector assembly 2010 includes three primary components: a lower mask piece 2012, an upper mask piece 2014 and a protector piece 2016. The upper mask piece 2014 and the protector piece 2016 of FIGS. 23A-B can be structurally and functionally identical to the upper mask piece 1914 and the protector piece 1916 of FIGS. 22A-B, respectively. As such, for brevity and conciseness, the characteristics of the mask piece 2014 and the protector piece 2016 will not be repeated. The lower mask piece 2012 includes an attachment mechanism, namely a pair of neck straps 2030A and 2030B, that is configured to attach the lower mask piece 2012 to the head 11 of a user. When properly situated on and attached to the user's head 11, the lower mask piece 2012 of FIGS. 23A-B extends across and covers a portion of the user's chin 19 and cheeks 21, and the user's mouth and nose. With this design, the mask pieces 2012, 2014 are separate, autonomous parts that are independently movable from one another. As seen in FIG. 23B, for example, the upper and lower mask pieces 2014, 2012 are individually repositionable on the user's head 11 and face 13.

In accord with some of the disclosed aspects, a four-part human face, head, neck and shoulder cover system is presented for protection against earthly environmental forces including sun, cold, wind, moisture, and flying debris. For some configurations, the cover system is fabricated from static or elastic soft-bodied, hard-bodied, or of both soft and hard-bodied elements. For some configurations, these elements do not cover the openings of the nostrils or the mouth, but at least one element covers the tip of the nose and has a portion of moldable material or a moldable component or components around the mouth and/or nose to fit to different faces and to create an opening ideal for ventilating breathing exhaust. At least one element of the cover system covers the nose, the cheeks, and the part of the face above the mouth. At least a second element of the cover system covers the cheeks and jaw and/or neck, though this element can cover all parts of the head, face, and neck, excluding the nose, eyes and mouth. At least a third element of the system may cover the head and/or neck and/or shoulders. An optional fourth element can be used to cover and uncover the mouth.

In accord with at least some of the disclosed aspects, the face-cover system may cover every part of the nose except for the nostrils, and may include material that extends beyond the tip of the nose as much as an inch and below the tip of the nose no lower than, and not inclusive of, the upper edge of the upper lip of the mouth. One or more parts of the face-cover system can besecured to the head by adjustable or non-adjustable elastic or static loops around the ears, and/or by an adjustable or non-adjustable elastic or static suspension system that connects to any point or portion of the face-cover, such as on either side of the face near the cheeks, and is slung over the crown of the user's head and behind the user's neck. The "top of the head" can be defined, for example, as an area inside the connection of four points on the head: 1. (front-most) the top of the forehead, 2. (left side), 3. (right side) where the top of the ear is connected to the head, and 4. (back-most and lowest) the back of the neck below the standard hairline. One or more parts of the face-cover system can optionally be suspended from a headband-like element that is situated around the circumference of the head, for example, level with the forehead. The face-cover system can optionally be attached to part of the user's goggles, glasses, jacket, hat, helmet, and the like.

In accord with at least some of the disclosed aspects, one or more of the components of the face-cover system can cooperatively define an outer edge that encircles the face. This outer edge can extend as far as two inches into the hairline beyond the face to ensure that all skin is protected. The face-cover system protects the area of the face inclusive of the forehead (upper edge), the ears and jaw (side edge), and the chin and jaw (lower edge). A lower edge of the system can be defined by the line created at the meeting of the jaw and neck, though it is possible for there to be soft or hard-bodied material projecting down from this line as much as one or two feet to protect the neck and shoulders of the user. An optional, but not necessary element of the system can cover the user's mouth. There can also be a covering for the user's lips that does not inhibit the opening and closing of the mouth or expulsion of breathing exhaust. In general, there is to be no covering over the nostrils, although there could be an amount of material around the near-outer-walls of the nostrils. This material would be used for securing the mask to the user and insulating a maximal amount of the nose. An element of the face-cover system, or separate from and attached to the face-cover system, can be used to cover the mouth and/or nose openings in the mask. This mouth cover must be quickly and easily placed over and removed from the mouth.

Inside or on one or more parts of the face-cover system there may be one or more moldable components, like a piece of plastic-coated wire that is stitched, glued, or secured to any part of the mask material to help the mask mold to a user's face and/or to hold it in place. These moldable components may be especially helpful around the user's nose. A moldable component could be shaped to create an ideal opening for ventilating breathing exhaust into the atmosphere, or to fit an array of nose shapes.

For some embodiments, the face-cover system includes a neck, head, and shoulder protector. In some embodiments, this element covers every part of the head, face, neck, and shoulders except for the mouth, eyes and nose, each of which can be covered by a second and/or third independently moving elements. This neck, head, and shoulder protector, which may be a static or an elastic soft body, covers at least every part of the head and neck not covered by the face mask elements (this area includes every part of the head typically covered by hair, and the entire neck). The neck, head, and shoulder protector can attach to the face mask elements by any means or can be used independently. The shoulder-skirt portion of the head and neck protector has a lower edge inclusive of at least six inches below the shoulders. This neck, head, and shoulder protector can be consist of one body or many bodies, and can be adjustable or fixed.

For some embodiments, the face-cover system includes a nose-and-cheek mask designed to protect predominantly the nose, upper-cheeks, and the area of the face between the eyes and ears with an upper edge near the tops of the eyebrows and ears to provide maximum breathing exhaust ventilation by not covering the mouth or nostrils. This mask covers the area of the face level with and above the mouth, between the ears, and as high as the eyebrows, not inclusive of the eye sockets. Some embodiments of the nose-and-cheek mask cover the forehead. Any part of the mask can be elastic or have elastic components. Elastic around the outer side and top edges would hold the mask tighter to the user's face.

The nose-and-cheek mask can have a width of approximately 3 inches to approximately 20 inches, and a height of approximately 0.5 inches to approximately 8 inches. The dimensions and shape of the face-cover system can varied to fit all human faces, from babies and infants to large adults. A "one size fits all" embodiment of the nose-and-cheek mask can be about 11 inches wide and 4 inches tall. This embodiment has an upper edge that traces the bottom edge of the eye sockets, across the top of the bridge of the nose at its center, around the sides of the eye sockets up to the eyebrows, and on a straight or not-straight line to the tops of the ears—either inclusive of or very nearly inclusive of the ear. This embodiment has a side edge that is inclusive of the ears, or very nearly inclusive of the ears. This embodiment has a bottom edge created by straight or not straight lines drawn between any possible points on the face, for example, from the bottom of the ears, to the corners of the mouth, then to two points on either side of the bottom edge of the nose. When the two points on either side of the nose are connected, they form the middle portion of the bottom edge of the mask that is an arch tracing the perimeter of the underside of the nose. This bottom edge could present an amount of material projecting downward from the tip of the nose. In some embodiments, this bottom edge contains a moldable element. This area of the mask protects the tip of the nose and nostrils from oncoming wind, but also provides the nearest-possible, and thus most-efficient escape route for nose exhaust. The face cover does not cover the mouth, but it does cover the nose and cheeks, and it provides the maximum ventilation of breathing exhaust as it does not cover the nostrils or mouth. The face cover may have an attachment piece or inherent capability to cover the upper lip of the user≥e.g., the area between the bottom edge of the nose and (not inclusive of) the upper edge of the upper lip.

For some embodiments, the nose-and-cheek mask attaches to the user's head by means of elastic or static or adjustable loops around the ears, attaches to another element of the system, attaches via a suspension system that connects to the mask on either side of the face and is slung over the top of crown of the head, and/or is suspended from a head-band-like element. This face-cover attachment system interferes only minimally with the putting on of a hat or helmet. This nose-and-cheek maskcould also be attachable to the any part of a jacket, helmet, hat, or pair of glasses or goggles. This part of the system could include material below the mouth, and if the material covered the jaw chin or below, it should have a component like elastic to allow the mouth to open and close, and the face to function normally in general.

For some embodiments, a chin-and-jaw mask protects the chin, jaw and cheeks, but does not cover the mouth (though it could cover the bottom lip), and is held onto the user's head by a static or elastic or adjustable suspension system. This chin-and-jaw mask covers the portion of the user's face below the mouth, although some material will cover portions of the cheeks above the mouth. The chin-and-jaw mask can also cover the chin and the underside of the jaw of the user between the neck and chin. This mask can be secured to the face by means of a suspension system that connects to the mask on either side of the face near the cheeks, and is slung over the top or crown of the head, or is suspended from a head-band like element. The suspension system secures the chin-and-jaw mask to the head by sandwiching the user's head between the suspension system (slung over the top of the head) and the jaw and cheek protector (under the jaw). This allows the jaw to articulate normally. The same suspension system could also provide the point to which the nose-and-cheek mask attaches to the head. This chin-and-jaw mask could optionally cover the face above the mouth and, if it did, there could be, for example, an elastic component around the nose to allow the mouth to open and close normally.

If the aforementioned chin-and-jaw mask and nose-and-cheek mask are used in combination, they create a system that covers the whole face, except for the eyes, nostrils and mouth. The face can articulate normally as the chin-and-jaw mask moves independently of the nose-and-cheek mask. Because there is minimal covering over the nostrils and mouth, breathing exhaust can be expelled more efficiently away from the face, goggles, and/or glasses of a user. Also, the user's mouth can be exposed for eating, drinking, talking, or any other activity requiring an uncovered mouth. The majority of the nose is covered for maximum insulation and protection, while allowing maximum breathing exhaust expulsion. These two components can be joined together by any means, including hook and loop, buttons, magnets, clips, clasps, loop and pile, peg/hole attachment means, fabric, or other connections. An optional additional element for covering the mouth could be attached to the face cover system by any of the aforementioned means. This optional element should be suspended from the mask or head by elastic so it can be placed out of the way, beneath the chin, then pulled over the mouth and nose in a situation of extreme cold when free-breathing isn't paramount.

Some embodiments are directed to a one-piece mask made of an upper portion that moves independently of the lower portion. This embodiment includes a design in which the portion of the mask that covers the area predominantly below the mouth (e.g., a jaw-and-lower-cheek mask) overlaps or is overlapped by the portion of the mask that covers the area predominantly above the mouth (the nose-and-upper-cheek mask). These two portion can move independently of one another to allow for easy mouth opening and closing and normal facial articulation. The portions of the upper and lower mask could be joined by a stretchy or static material that prevents water and snow from reaching the face should it get between the upper and lower portions of the mask. This material has enough slack or is sufficiently "stretchy" so as to allow for normal facial articulation without displacing the situation of the mask on the face. This mask can be put on as one piece but, due to the elasticity around the nose and/or chin, it functions like a two to four-piece mask.

In accordance with some of the disclosed aspects is a nose-tip pocket that helps secure the mask to the desired place on the user's nose while simultaneously protecting the tip of the nose from the elements. For some embodiments, this nose-tip pocket must completely expose the nostrils to efficiently ventilate breathing exhaust away from the face and into the open atmosphere. If the user requires greater ventilation, the nose-tip pocket can be moved off of the nose and, for example, positioned to then lay flat across top of the nose. This pocket can be created by adhering a flat element of material to the side of the mask in contact with the face. The material is adhered on the bottom and side edges, leaving the top edge open for receiving the nose.

As indicated above, each component of the face-cover systems disclosed herein can be connected to the head by any now known or hereinafter developed means. As some non-limiting examples, the attachment means may include ear-loops and a suspension system consisting two or more straps—e.g., one strap extending over the top or crown of the head and a second strap extending around the back of the neck. The ear-loops and suspension system named can be adjustable or can be made with materials having an ideal inherent elasticity that does not require adjustment. The length(s) of the strap(s) that connect the face-cover to the user can be changed to fit a wide variety of head sizes, or are sufficiently stretchy so as to fit all people in a predetermined size-range. The length of the straps can be changed by any existing or future means of attaching two pieces of material (e.g., hook and loop, sliders on webbing, snaps, clips, clasps, button/hole, etc.).

Many of the elements of the face-cover system may comprise a material that can be elastic or can have elastic components. These elastic components can be configured to allow the jaw to open and close easily and comfortably while holding the face-cover tight to the face. A multi-piece embodiment can include a system in which the piece of the mask that covers the area predominantly below the mouth (e.g., jaw-and-lower-cheek mask) overlaps or is overlapped by the piece of the mask that covers the area predominantly above the mouth (e.g., nose-and-upper-cheek mask). These two pieces move independently of one another to allow for easy mouth opening and closing and normal facial articulation. The upper and lower mask pieces can optionally be joined together by a stretchy or static material that acts as a barrier to prevent water and snow from reaching the face should it get between these pieces of the mask system. This material would have enough slack or be sufficiently stretchy so as to allow for normal facial articulation without displacing the positioning of the mask on the face.

Attached to the face-cover system can be a "nose tip cap" made of a material that is tacky against skin and is insulating, like rubber. This nose cap could also be made of metal, plastic, or any solid or soft bendable or moldable material. These elements can be covered with an insulating coating or a covering, for example, to prevent the user's skin from contacting elements that readily conduct cold. The nose cap can be configured to help secure the face-cover to a desired place on the user's nose and to insulate the nose without covering the nostrils. The nose cap can cover all portions of the nose except for the nostril openings. Some embodiments may cover less than all portions of the nose so long as they sufficiently cover the nose tip.

The nose cap can consist of or include an element that functions as a spring, which is configured to secure the mask to the nose by pulling up on the bottom of the nose tip near the columella by a pair of ear loops or a suspension system. This spring could also keep the material of the nose skirt away from the nostrils so to maximize the ventilation of nasal exhaust. The spring could be made of one element or many elements, and can be made of any material that, when molded or shaped, produces a low tension spring (embodiments use thin strips of moldable plastics and metal).

To fit many different-sized faces with one mask, this face-cover system can have margins that can be trimmed or cut by the user in order to achieve an ideal, customizable fit. Any outer edge of the face-cover, or any material near the mouth, nose, nostrils, or eyes could be trimmable and, optionally, could be marked with guidelines to assist with trimming. For some embodiments, all margins of this mask could be trimmable. The area of the mask that covers the tip of the nose and the area between the nostrils and tip of the nose could be trimmable. The size and shape the nose is greatly varied in humans, so configuring this area of the mask to be customizable by the user would ensure a good fit and, thus, a properly functioning mask. Other margins that could be trimmable include the upper-most margin of this mask which traces the outside edge of the eye sockets of the user, and the side margins which could be trimmed just inside the ears (not inclusive of the ears) or just outside of the ears (inclusive of the ears) of the user. Finally, some users would want this mask to cover more of their cheeks than others, so a trimmable bottom margin could also be desirable. All of the outer margins of the jaw-and-lower-cheek mask could be trimmable. As the distance between the tip of the chin and bottom edge of the bottom lip of humans greatly varies, trimmable margins around the mouth can be beneficial. The distance between the tip of the chin and ears of users varies, so trimmable margins around the ears could also be useful. The distance between the tip of the chin and neck of users varies, so trimmable margins around the where the neck and jaw meet could also be useful. Finally, some users would want this mask to cover more of their cheeks than others, so the area between the nose and ears (cheeks) could be trimmable.

One or more elements of the face-cover system can be entirely made of a moldable or bendable material or, as discussed above, can have one or more moldable or bendable components. Throughout the mask, it is possible to include a moldable or bendable frame, or moldable/bendable sections or features of the mask to help give the mask structure and to provide a more custom fit to each user. A thin piece of metal, plastic, or any material in a sheet, strip, web, or any shape, material, or construction that, when molded, will hold its form and/or have the ability to change forms could be used. A moldable and/or bendable component to form around the nose, and contour the eye sockets and cheeks would be particularly useful. This frame could be used to create an aerodynamic shape to hold the mask to the face in a windy environment or high-speed application. The moldable component could be attached to the mask by any means including, but not limited to, material enclosures, stitching, and adhesives.

Due to the variety of possible human nose shapes, the face-cover system can include an adjustable or elastic nose pocket. This pocket would allow the mask to stay tight to the face of a person who has a small nose. It could also stretch or be adjustable to accommodate a bigger nose. This nose pocket can be made of elastic material and/or can be adjustable. This nose pocket can cover all areas of the nose and/or areas around the nose. This nose pocket could be adjustable by any means, such as loop/pile, clips, and clasps. This nose pocket can also be suspended by elastic straps so as to not require adjustment. This nose expansion system can be a separate sling, or pocket inside the face-cover.

Due to the variety of possible human chin shapes, the face-cover system can include an adjustable or elastic chin pocket. This pocket could allow the mask to stay tight to the face of a person who has a small chin. This chin pocket can also stretch or be adjustable to accommodate a bigger chin. This chin pocket can be made of elastic materials so as to require no adjustment, and/or can be adjustable by any means such as loop/pile, clips, and clasps. This chin expansion system can be a separate sling, or pocket inside the face-cover, and/or the chin of the exterior of the mask is adjustable or expandable in this manner.

For some embodiments, a soft-bodied neck-protector and hood system can be attached to a portion of the aforementioned face-cover system to be used in combination with the other elements or, alternatively, to be used independently. The neck protector covers and protects at least every part of the head and neck not covered by the face cover element. In some embodiments, the neck protector covers the head, neck, shoulders and face, not inclusive of the eyes, nose and mouth. The neck protector can attach to the other components of the system by any means (loop/pile, clips, clasps, loop/hook). Alternatively, the neck protector can be used with other face cover elements without attaching them. The neck protector can be sufficiently long so as to extend like a skirt as much as six inches below the shoulders.

The neck protector can be made of a single body or several bodies that can be used independent of one another. These parts can include: a hood that covers the head and back of the neck; a neck-gaiter that attaches to the bottom of the face-cover where the jaw meets the neck and wraps around the back of the neck where it does or does not attach to the neck cover form the hood element; and, a shoulder skirt that cover the tops of the shoulders and neck. The shoulder skirt interferes minimally with movement of the arms and hangs down at most two feet at the center of the chest and center of the back so as to prevent heat-loss. The neck-gaiter can have material that protects the cheeks above the mouth, and can have a strap that extends over the crown of the head to hold it in place. In some embodiments, all of these elements formed as a single-piece unit. In other embodiments, the part that covers the top of the head can be removable or omitted for maximum body-heat ventilation.

For some embodiments, one or more pieces of the disclosed face-cover systems can serve as an advertising platform. Any design: letter(s), number(s), word(s), image(s), symbol(s) could be inherent to the material of the face-cover, can be stitched into the material of the face-cover, printed on the material, embossed on the material, burned on the material, etc., for advertisement, marketing, or individualizing.

One or more embodiments can be directed to a "warm weather" face mask system that can include any or all of the elements and features presented above, but would be made of a material that is operable to block the sun, that is highly breathable, that is quick-drying, or any combination thereof. It may be desirable that the material of this mask reflects a minimal amount of light into the user's eyes, while absorbing as little heat as possible. This mask could be made of medical-grade materials for use in protecting the faces of post-operative patients and those who are particularly concerned with sun-exposure.

One or more of the components of the disclosed face-cover systems can be replaceable. Having replaceable components affords this mask a longer use life. It also allows the seller to guarantee the product with little risk of it being returned. If the components most prone to failure (e.g., the straps) are replaceable, those components also become products in and of themselves. Thus, what would normally be a cost becomes a sale in selling replacement straps. Because the straps are replaceable, any type of strap or material can be used to attach the mask to a user or his or her headwear.

Button holes in the facemask material can facilitate replaceable and exchangeable straps. Thus, if the straps wear out, become over stretched, or break before the facemask is worn out, they can be replaced, extending product life. With certain button hole configurations, the straps can be attached in three configurations: top-to-bottom on the same side (earloops), top-to-top and bottom-to-bottom on opposite sides (like a dust mask—with one strap on top of the head, and the other on the back of the neck), or top-to-bottom on opposite sides (making an "x" behind the user's head). Many different strap lengths, types, or head-wear attachment options could be produced to work with a facemask panel that has button holes. Because there can be straps of many lengths, there needn't be a strap length adjustment on each strap. This saves on weight, and adds to comfort as there will be no metal or plastic adjusters on the straps to harm the wearer, or conduct the cold to his or her skin.

For some embodiments, the most comfortable straps to secure a mask behind the ears are soft and have a high stretch coefficient (are very stretchy). For some embodiments, the most comfortable ear-loop elastic may not be the strongest. To have comfortable, but weak straps on a tough, long-lasting mask, it would be helpful to have replaceable straps.

For some embodiments, ear loops and/or head-straps can have soft "buttons" or discs sewn to their ends. These buttons fit into the button-holes of the face mask panel securing the mask to the straps. The buttons feel soft against the user's face, will not interfere with goggles or helmets, will seal completely the button-hole, and will be easy to change, though not so easy that they pull out unwantedly. For some embodiments, if the ear loops are replaceable, there need not be a size adjustment on the ear loop or mask. Straps could be made of any width, color, material, or design because if they are replaceable.

For some embodiments, the button holes on the mask and buttons on the ends of the straps make the straps replaceable or exchangable. Straps could be made of every length, width, color, material, and design because they are replaceable. Also, if the straps wear out before the mask panel, they can be replaced extending the life of the mask.

For some embodiments, one or more pieces of the face-cover system can have a pocket or an attachment method to hold a heat-pack. Such heat-packs are typically made of a chemical compound that becomes hot when exposed to air. Theses heat-packs are typically used to keep toes or fingers warm. As the nose is a vulnerable extremity like the fingers and toes, a heat-pack would be particularly useful over the nose and cheeks to prevent frostbite.

For some embodiments, a thin, plastic coated wire, much like that used as a twist-tie for closing bread bags, is fed between the needles of a twin-needle sewing machine and enclosed in fabric binding along the bottom edge of the mask that protects the nose and cheeks. The two rows of stitching prevent the wire from moving out of position, and attach it in a binding enclosure to the bottom edge of the mask. The sewing machine foot must be modified. A groove a little wider than the wire (or moldable strip) must to be created along the full length of the bottom-center of the foot, running in line with the work. The wire will be fed through this groove and held consistently in the desired position between the twin needles. A fold-over elastic binding feeder must be positioned as close as possible to needles to prevent the work from moving before it reaches the needles.

While many embodiments and modes for carrying out the present invention have been described in detail above, those familiar with the art to which this invention relates will recognize various alternative designs and embodiments for practicing the invention within the scope of the appended claims.

What is claimed is:

1. A face protector comprising:

a mask piece with opposing top and bottom edges and a back surface, the mask piece being configured to extend across and cover with the back surface at least a portion of a user's cheeks and substantially all of the user's nose; and a first attachment mechanism configured to attach the mask piece to the user's head;

wherein the mask piece includes a fabric extension protruding from and folded back along the bottom edge of the mask piece and onto the back surface of the mask piece forming a bottom side portion of the fabric extension, the bottom side portion being adhered to the back surface of the mask piece; wherein the extension further includes a first side portion adhered to the back surface of the mask piece, a second side portion, opposite the first side portion, adhered to the back surface of the mask piece, and a top side portion, opposite a bottom side portion, which is not adhered to the back surface of the mask piece and which includes a curved edge;

wherein the fabric extension and the mask piece are configured to form a nose cup when the mask piece is placed on the user, wherein the nose cup extends in a first direction from a top portion proximate the top edge of the mask piece to a bottom portion proximate the bottom edge of the mask piece, the nose cup further including a nose flap affixed to the bottom portion of the nose cup and extending in a second direction at an angle with respect to the first direction, and wherein the curved edge of the top side portion of the fabric extension forms two curved portions of the nose flap configured to lie at least partially coterminous with the nostrils of the user.

2. The face protector assembly of claim 1, wherein the nose cup includes one or more moldable elements extending laterally across the nose cup transverse to the first direction or in the first direction and configured to be bent to fit the nose cup to the contours of the user's nose.

3. The face protector of claim 1, further including a lower mask piece having a top edge and a bottom edge, wherein the lower mask piece is separate and independently movable from the mask piece.

4. The face protector of claim 3, further including a second attachment mechanism for the lower mask, wherein the second attachment mechanism comprises a crown strap configured to extend over the crown of the user's head.

5. The face protector of claim 4, wherein the second attachment mechanism further comprises a neck strap configured to extend around the user's neck.

6. The face protector of claim 1, wherein the first attachment mechanism includes a crown strap configured to extend over the crown of the user's head.

7. The face protector of claim 6, wherein the first attachment mechanism further comprises a neck strap configured to extend around the user's neck.

8. The face protector of claim 6, wherein the first attachment mechanism further comprises ear loops each configured to extend around one of the user's ears.

9. The face protector of claim 3, wherein a portion of the top edge of the lower mask piece is configured to overlap a portion of the bottom edge of the mask piece.

10. The face protector of claim 1, further comprising a protector piece configured to extend across and cover at least a portion of the user's neck and head.

11. The face protector of claim 10, wherein the protector piece is further configured to extend across and cover at least a portion of the user's shoulders, at least a portion of the user's face, or both.

12. The face protector of claim 10, wherein the protector piece includes a region of increased elasticity adjacent the user's neck, the region of increased elasticity being configured to increase mobility of the user's head.

13. The face protector of claim 10, wherein the protector piece includes a facial opening configured to encircle the user's face such that at least the user's eyes and nose project through the facial opening.

14. The face protector of claim 3, wherein the lower mask piece is further configured to extend across and cover at least a portion of the user's neck.

15. The face protector of claim 3, wherein the lower mask piece is further configured to extend across and cover at least a portion of the user's ears.

16. The face protector of claim 6, wherein the mask piece is further configured to extend across and cover at least a portion of the user's forehead.

* * * * *